US012584435B2

(12) United States Patent
Hall et al.

(10) Patent No.: US 12,584,435 B2
(45) Date of Patent: Mar. 24, 2026

(54) METHOD OF OPERATING A COOLING SYSTEM, COMPUTER PROGRAM, COMPUTER-READABLE MEDIUM, CONTROL ARRANGEMENT, COOLING SYSTEM, AND VEHICLE

(71) Applicant: Scania CV AB, Södertälje (SE)

(72) Inventors: Ola Hall, Stockholm (SE); Zoltan Kardos, Södertälje (SE)

(73) Assignee: Scania CV AB, Södertälje (SE)

( * ) Notice: Subject to any disclaimer, the term of this patent is extended or adjusted under 35 U.S.C. 154(b) by 0 days.

(21) Appl. No.: 18/870,349

(22) PCT Filed: May 22, 2023

(86) PCT No.: PCT/SE2023/050502

§ 371 (c)(1),
(2) Date: Nov. 27, 2024

(87) PCT Pub. No.: WO2023/234826

PCT Pub. Date: Dec. 7, 2023

(65) Prior Publication Data

US 2025/0369385 A1 Dec. 4, 2025

(30) Foreign Application Priority Data

Jun. 3, 2022 (SE) ..... 2250670-3

(51) Int. Cl.
*F01P 11/02* (2006.01)
*F01P 3/20* (2006.01)
(Continued)

(52) U.S. Cl.
CPC ..... *F01P 3/20* (2013.01); *F01P 5/10* (2013.01); *F01P 11/04* (2013.01); *F01P 2005/105* (2013.01)

(58) Field of Classification Search
CPC combination set(s) only.
See application file for complete search history.

(56) References Cited

U.S. PATENT DOCUMENTS 4,630,573 A 12/1986 Ogawa et al.
7,984,699 B2 7/2011 Theorell
(Continued)

FOREIGN PATENT DOCUMENTS

EP 0182340 A2 5/1986
GB 2497387 A 6/2013
(Continued)

OTHER PUBLICATIONS

Nov. 25, 2021—(SE) Search Report.
Jul. 19, 2023—(WO) International Search Report & Written Opinion—PCT/SE2023/050502.

*Primary Examiner* — George C Jin
*Assistant Examiner* — Teuta B Holbrook
(74) *Attorney, Agent, or Firm* — Banner & Witcoff, Ltd.

(57) ABSTRACT

A method of operating a cooling system of a vehicle is disclosed. The cooling system comprises a first and a second coolant circuit. The first coolant circuit comprises a first coolant pump, a conduit section connected to a pump inlet of the first coolant pump, a primer conduit, a filling point, and a conduit portion located between the filling point and the pump inlet, wherein the conduit portion is arranged below the pump inlet. The method comprises the steps of initiating a supply of coolant from the second coolant circuit to the conduit section via the primer conduit during standstill of the first coolant pump, and then initiating operation of the first coolant pump. The present disclosure further relates to a computer program, a computer-readable medium, a control arrangement, a cooling system, and a vehicle.

17 Claims, 3 Drawing Sheets

(51) Int. Cl.
*F01P 5/10* (2006.01)
*F01P 11/04* (2006.01)

(56) References Cited

U.S. PATENT DOCUMENTS

| | | | |
|---|---|---|---|
| 9,744,827 | B2 | 8/2017 | Nishikawa et al. |
| 2005/0167169 | A1 | 8/2005 | Gering et al. |
| 2018/0050605 | A1 | 2/2018 | Lewis et al. |
| 2021/0300147 | A1 | 9/2021 | Sakamoto et al. |

FOREIGN PATENT DOCUMENTS

| | | | |
|---|---|---|---|
| GB | 2561599 | A | 10/2018 |
| JP | 0347422 | A | 2/1991 |
| JP | 4465918 | B2 * | 5/2010 |
| SE | 1451549 | A1 | 6/2016 |
| SE | 1651510 | A1 | 5/2018 |
| SU | 1211429 | A1 | 2/1986 |
| WO | 2020104063 | A1 | 5/2020 |
| WO | 2021138221 | A1 | 7/2021 |

* cited by examiner

METHOD OF OPERATING A COOLING SYSTEM, COMPUTER PROGRAM, COMPUTER-READABLE MEDIUM, CONTROL ARRANGEMENT, COOLING SYSTEM, AND VEHICLE

CROSS-REFERENCE TO RELATED APPLICATIONS

The present application claims priority from and is a U.S. National Phase of International Application No. PCT/SE2023/050502, which was filed on May 22, 2023, designating the United States of America and claiming priority to Swedish Patent Application No. 2250670-3, filed on Jun. 3, 2022. This application claims priority to and the benefit of the above-identified applications, which are all fully incorporated by reference herein in their entireties.

TECHNICAL FIELD

The present disclosure relates to a method of operating a cooling system of a vehicle. The present disclosure further relates to a computer program, a computer-readable medium, a control arrangement for controlling operation of a cooling system of a vehicle, a cooling system for a vehicle, and a vehicle comprising a cooling system.

BACKGROUND

Modern vehicles usually comprise several cooling circuits each arranged to cool one or more vehicle components such as a combustion engine, an electric propulsion system, an electric propulsion motor, power electronics, a propulsion battery, a retarder, a waste heat recovery circuit, and the like. Such cooling circuits usually comprise a coolant pump and one or more radiators arranged to transfer heat from the cooling circuit to ambient air. Radiators are usually arranged at a front of a vehicle to be subjected to the air flow generated during driving of the vehicle. Moreover, radiators can be provided with one or more cooling fans arranged to blow air through the radiators. In this manner, an air flow through the radiators can be generated also when the vehicle is driving at low speeds or is at stand still.

Preferably it should be ensured that the cooling circuit is filled with coolant to an intended coolant level before operating the coolant circuit. Upon assembly of vehicles, coolant is normally filled after assembly of all parts of a cooling circuit. Moreover, during service, repair and maintenance of vehicles, a coolant circuit may at least partially be drained of coolant which causes air to enter the circuit. Furthermore, leakage of coolant may occur which also causes air to enter the circuit.

Air in a coolant circuit significantly reduces the efficiency of the coolant circuit, partly because air has a much lower specific heat capacity than coolant. Moreover, air inside a coolant circuit may harm components of the coolant circuit. As an example, bearings of the coolant pump of the coolant circuit risks overheating if the coolant pump is operated with an insufficient supply of coolant to a pump inlet of the coolant pump. At least partly as a reason thereof, a coolant pump is normally arranged at a low position in a coolant circuit. In this manner, the pump inlet of the coolant pump is fed with coolant with help of gravity.

In order to avoid operation of a coolant circuit with a too low coolant level, a manual deaeration of the coolant circuit must normally be performed. Manual deaerations of coolant circuits is time-consuming and must normally be performed by professionals in a workshop. In most cases, a vehicle should not be operated with an insufficient level of coolant in a coolant circuit to avoid damage of the coolant system and the components being cooled by the coolant circuit.

Technical development has led to an increased number of systems and components packed into vehicles. For example, the current trend of electrification of vehicles has increased this number significantly. The use of electric drive for vehicles provides many advantages, especially regarding local emissions. Such vehicles comprise one or more electric machines configured to provide motive power to the vehicle. These types of vehicles can be divided into the categories pure electric vehicles and hybrid electric vehicles. Pure electric vehicles, sometimes referred to as battery electric vehicles, only-electric vehicles, and all-electric vehicles, comprise a pure electric powertrain and comprise no internal combustion engine and therefore produce no emissions in the place where they are used.

A hybrid electric vehicle comprises two or more distinct types of power, such as an internal combustion engine and an electric propulsion system. The combination of an internal combustion engine and an electric propulsion system provides advantages with regard to energy efficiency compared to vehicles using only an internal combustion engine, partly because of the poor energy efficiency of an internal combustion engine at lower power output levels. Moreover, some hybrid electric vehicles are capable of operating in pure electric drive when wanted, such as when driving in certain areas requiring low noise levels and/or low emission levels.

The use of electric drive for vehicles is also associated with some problems and drawbacks. One problem is storage of electricity in the vehicle. The electricity is stored in batteries of the vehicle and some different types of batteries are used, such as lithium-ion batteries, lithium polymer batteries, and nickel-metal hydride batteries. Several batteries are needed to ensure sufficient operational range of a vehicle, especially on long range battery electric trucks and busses.

A battery generates heat during charging and discharging. Too high temperatures and too low temperatures may damage and/or reduce lifetime of a battery. Moreover, batteries have a reduced efficiency at low and high temperatures. Therefore, vehicles with electric drive comprise a battery cooling system capable of controlling the temperature of the batteries of the vehicle. On heavier vehicles, such as long-range battery electric trucks and busses, the battery cooling system usually comprises one coolant circuit, or branch, per battery pack, or one coolant circuit, or branch, per group of battery packs.

The increased number of systems and components of modern vehicles leads to packing problems, and it can be difficult to fit all components and systems needed. Moreover, the routing of conduits and the placement of other parts of the cooling circuits can be problematic.

Moreover, generally, on today's consumer market, it is an advantage if vehicles and their associated components, systems, and arrangements have conditions and/or characteristics suitable for being assembled and operated in a cost-efficient manner.

SUMMARY

It is an object of the present invention to overcome, or at least alleviate, at least some of the above-mentioned problems and drawbacks.

According to a first aspect of the invention, the object is achieved by a method of operating a cooling system of a vehicle, the cooling system comprising a first and a second coolant circuit each configured to control the temperature of a number of components of the vehicle, wherein the cooling system comprises a filling point for filling the first coolant circuit with coolant, and wherein the first coolant circuit comprises:

a first coolant pump configured to pump coolant through the first coolant circuit, a conduit section connected to a pump inlet of the first coolant pump, a primer conduit connected to the conduit section and to the second coolant circuit, and a conduit portion located between the filling point and the pump inlet of the first coolant pump, wherein the conduit portion is arranged below the pump inlet of the first coolant pump as seen relative to a local gravity vector, and wherein the method comprises the steps of:

initiating a supply of coolant from the second coolant circuit to the conduit section via the primer conduit during standstill of the first coolant pump, and then initiating operation of the first coolant pump.

Since the method comprises the steps of initiating a supply of coolant from the second coolant circuit to the conduit section via the primer conduit during standstill of the first coolant pump, and then initiating operation of the first coolant pump, a method is provided circumventing, or at least reducing the need for performing, a manual deaeration of the first coolant circuit. This is because the supply of coolant from the second coolant circuit to the conduit section via the primer conduit can ensure that the pump inlet of the first coolant pump is supplied with coolant before operation of the first coolant pump is initiated.

Furthermore, since the first coolant circuit comprises the conduit portion arranged between the filling point and the pump inlet, wherein the conduit portion is arranged below the pump inlet of the first coolant pump as seen relative to the local gravity vector, it cannot be ensured that the pump inlet of the first coolant pump is filled with coolant when coolant is filled into the filling point of the cooling system. This is because air in the first coolant circuit downstream of the conduit portion may create an airlock which prevents a flow of coolant from the filling point to the pump inlet of the first coolant pump. That is, due to the conduit portion arranged below the pump inlet, coolant is hindered from flowing naturally, i.e., by gravity, continuously downwards from the filling point to the pump inlet. Moreover, air cannot naturally, i.e., by gravity, move up continuously from the pump inlet to the filling point.

However, since the method comprises the steps of initiating the supply of coolant from the second coolant circuit to the conduit section via the primer conduit, it can be ensured that the pump inlet of the first coolant pump is supplied with coolant before operation of the first coolant pump is initiated despite the fact that the first coolant circuit comprises the conduit portion arranged below the pump inlet of the first coolant pump as seen relative to the local gravity vector.

Moreover, the method provides conditions for more freedom in the vertical placement of the first coolant pump relative to other parts of the cooling system while ensuring that the pump inlet of the first coolant pump is supplied with coolant before initiating operation of the first coolant pump. For example, the method provides conditions for a cooling system in which the first coolant pump is arranged at a higher position than a coolant level of the second coolant circuit as seen relative to a local gravity vector when the vehicle is positioned in an upright use position on a horizontal surface, while ensuring that the pump inlet of the first coolant pump is supplied with coolant before initiating operation of the first coolant pump. In this manner, a method is provided which can reduce packing problems and facilitate the routing and placement of conduits and other parts of cooling systems of vehicles.

In addition, since the need for performing a manual deaeration of the first coolant circuit is circumvented, or at least reduced, a method is provided having conditions for reducing assembly costs, service, repair, and maintenance costs, as well as operational costs of vehicles. This is because the method provides conditions for filling the first coolant circuit with coolant from the second coolant circuit instead of preforming a manual deaeration of the first coolant circuit.

Moreover, a method is provided capable of reducing the risk of damage of the first coolant pump and the number of components of the vehicle being temperature controlled by the first coolant circuit. As a further result, a method is provided capable of reducing the risk of vehicle standstills due to an insufficient supply of coolant to the first coolant pump of the first coolant circuit.

Accordingly, a method is provided overcoming, or at least alleviating, at least some of the above-mentioned problems and drawbacks. As a result, the above-mentioned object is achieved.

Optionally, the Method Further Comprises the Step of:

supplying coolant from the second coolant circuit to the conduit section via the primer conduit during a first time period before the step of initiating operation of the first coolant pump.

Thereby, a method is provided capable of further reducing the risk of damage of the first coolant pump and the number of components of the vehicle being temperature controlled by the first coolant circuit caused by an insufficient supply of coolant to the first coolant pump. Moreover, a method is provided further reducing the need for performing a manual deaeration of the first coolant circuit.

Optionally, the Method Further Comprises the Steps of:

maintaining operation of the first coolant pump during a second time period, stopping operation of the first coolant pump at the end of the second time period, and then initiating a second supply of coolant from the second coolant circuit to the conduit section via the primer conduit.

Thereby, a method is provided capable of further reducing the risk of damage of the first coolant pump, and the number of components of the vehicle being temperature controlled by the first coolant circuit, caused by an insufficient supply of coolant to the first coolant pump. This is because the stopping of the operation of the first coolant pump and the initiation of the second supply of coolant can ensure that the conduit section and the pump inlet of the first coolant pump are not emptied of coolant by the operation of the first coolant pump during the second time period. In other words, in this manner, it can be ensured that the conduit section and the pump inlet of the first coolant pump are filled with coolant during operation of the first coolant pump. As a further result, a method is provided further reducing the need for performing a manual deaeration of the first coolant circuit.

Optionally, the Method Comprises the Step of:

maintaining the supply of coolant from the second coolant circuit to the conduit section via the primer conduit during operation of the first coolant pump.

Thereby, a method is provided capable of further reducing the risk of damage of the first coolant pump and the number of components of the vehicle being temperature controlled by the first coolant circuit caused by an insufficient supply of coolant to the first coolant pump. This is because it can be ensured that the conduit section and the pump inlet of the first coolant pump is filled with coolant during operation of the first coolant pump. As a further result, a method is provided further reducing the need for performing a manual deaeration of the first coolant circuit.

Optionally, the Method Comprises the Step of:

operating the first coolant pump with a reduced pumping rate when supplying coolant from the second coolant circuit to the conduit section via the primer conduit.

Thereby, it can be ensured that the conduit section and the pump inlet of the first coolant pump is not emptied of coolant when the first coolant pump is operated. As a result, a method is provided capable of further reducing the risk of damage of the first coolant pump and the number of components of the vehicle being temperature controlled by the first coolant circuit. Moreover, a method is provided further reducing the need for performing a manual deaeration of the first coolant circuit.

Optionally, the primer conduit is connected to a pressure portion of the second coolant circuit, and wherein the first coolant circuit comprises a valve controllable between an open state, in which the valve allows flow of coolant through the primer conduit, and a closed state, in which the valve blocks flow of coolant through the primer conduit, and wherein the step of initiating a supply of coolant from the second coolant circuit to the conduit section via the primer conduit comprises the step of:

controlling the valve to the open state.

Thereby, a method is provided capable of reducing the risk of damage of the first coolant pump and the number of components of the vehicle being temperature controlled by the first coolant circuit in a simple and cost-efficient manner circumventing the need for a separate pump for pumping coolant from the second coolant circuit to the conduit section via the primer conduit.

Optionally, the second coolant circuit comprises a second coolant pump, and wherein the primer conduit is connected to a portion of the second coolant circuit located downstream of the second coolant pump, and wherein the step of initiating a supply of coolant from the second coolant circuit to the conduit section comprises the step of:

operating the second coolant pump.

Thereby, a method is provided capable of reducing the risk of damage of the first coolant pump and the number of components of the vehicle being temperature controlled by the first coolant circuit in a cost-efficient manner circumventing the need for a separate pump for pumping coolant from the second coolant circuit to the conduit section via the primer conduit. This is because the method utilizes the second coolant pump for pumping coolant from the second coolant circuit to the conduit section via the primer conduit.

As a further result, the method allows for a less complex cooling system having conditions and characteristics suitable for being manufactured and assembled in a cost-efficient manner.

According to a second aspect of the invention, the object is achieved by a computer program comprising instructions which, when the program is executed by a computer, cause the computer to carry out the method according to some embodiments of the present disclosure. Since the computer program comprises instructions which, when the program is executed by a computer, cause the computer to carry out the method according to some embodiments described herein, a computer program is provided which provides conditions for overcoming, or at least alleviating, at least some of the above-mentioned drawbacks. As a result, the above-mentioned object is achieved.

According to a third aspect of the invention, the object is achieved by a computer-readable medium comprising instructions which, when executed by a computer, cause the computer to carry out the method according to some embodiments of the present disclosure. Since the computer-readable medium comprises instructions which, when the program is executed by a computer, cause the computer to carry out the method according to some embodiments described herein, a computer-readable medium is provided which provides conditions for overcoming, or at least alleviating, at least some of the above-mentioned drawbacks. As a result, the above-mentioned object is achieved.

According to a fourth aspect of the invention, the object is achieved by a control arrangement for controlling operation of a cooling system of a vehicle, the cooling system comprising a first and a second coolant circuit each configured to control the temperature of a number of components of the vehicle, wherein the cooling system comprises a filling point for filling the first coolant circuit with coolant, and wherein the first coolant circuit comprises:

a first coolant pump configured to pump coolant through the first coolant circuit, a conduit section connected to a pump inlet of the first coolant pump, a primer conduit connected to the conduit section and to the second coolant circuit, and a conduit portion located between the filling point and the pump inlet of the first coolant pump, wherein the conduit portion is arranged below the pump inlet of the first coolant pump as seen relative to a local gravity vector, and wherein the control arrangement is configured to:

initiate a supply of coolant from the second coolant circuit to the conduit section via the primer conduit during standstill of the first coolant pump, and then initiate operation of the first coolant pump.

Since the control arrangement is configured to initiate a supply of coolant from the second coolant circuit to the conduit section via the primer conduit during standstill of the first coolant pump, and then initiate operation of the first coolant pump, a control arrangement is provided circumventing, or at least reducing the need for performing, a manual deaeration of the first coolant circuit.

This is because the supply of coolant from the second coolant circuit to the conduit section via the primer conduit can ensure that the pump inlet of the first coolant pump is supplied with coolant before operation of the first coolant pump is initiated.

Furthermore, since the first coolant circuit comprises the conduit portion arranged between the filling point and the pump inlet, wherein the conduit portion is arranged below the pump inlet of the first coolant pump as seen relative to the local gravity vector, it cannot be ensured that the pump inlet of the first coolant pump is filled with coolant when coolant is filled into the filling point of the cooling system. This is because air in the first coolant circuit downstream of the conduit portion may create an airlock which prevents a flow of coolant from the filling point to the pump inlet of the first coolant pump. That is, due to the conduit portion arranged below the pump inlet, coolant is hindered from flowing naturally, i.e., by gravity, continuously downwards from the filling point to the pump inlet. Moreover, air cannot naturally, i.e., by gravity, move up continuously from the pump inlet to the filling point.

However, since the control arrangement is configured to initiate the supply of coolant from the second coolant circuit to the conduit section via the primer conduit, it can be ensured that the pump inlet of the first coolant pump is supplied with coolant before operation of the first coolant pump is initiated despite the fact that the first coolant circuit comprises the conduit portion arranged below the pump inlet of the first coolant pump as seen relative to the local gravity vector.

Moreover, the control arrangement provides conditions for more freedom in the vertical placement of the first coolant pump relative to other parts of the cooling system while ensuring that the pump inlet of the first coolant pump is supplied with coolant before initiating operation of the first coolant pump. For example, the control arrangement provides conditions for a cooling system in which the first coolant pump is arranged at a higher position than a coolant level of the second coolant circuit as seen relative to a local gravity vector when the vehicle is positioned in an upright use position on a horizontal surface, while ensuring that the pump inlet of the first coolant pump is supplied with coolant before initiating operation of the first coolant pump. In this manner, a control arrangement is provided which can reduce packing problems and facilitate the routing and placement of conduits and other parts of cooling systems of vehicles.

In addition, since the need for performing a manual deaeration of the first coolant circuit is circumvented, or at least reduced, a control arrangement is provided having conditions for reducing assembly costs, service, repair, and maintenance costs, as well as operational costs of vehicles. This is because the control arrangement provides conditions for filling the first coolant circuit with coolant from the second coolant circuit instead of preforming a manual deaeration of the first coolant circuit.

Moreover, a control arrangement is provided capable of reducing the risk of damage of the first coolant pump and the number of components of the vehicle being temperature controlled by the first coolant circuit. As a further result, a control arrangement is provided capable of reducing the risk of vehicle standstills due to an insufficient supply of coolant to the first coolant pump of the first coolant circuit.

Accordingly, a control arrangement is provided overcoming, or at least alleviating, at least some of the above-mentioned problems and drawbacks. As a result, the above-mentioned object is achieved.

It will be appreciated that the various embodiments described for the method are all combinable with the control arrangement as described herein. That is, the control arrangement according to the fourth aspect of the invention may be configured to perform any one of the method steps of the method according to the first aspect of the invention.

According to a fifth aspect of the invention, the object is achieved by a cooling system for a vehicle, wherein the cooling system comprises a first and a second coolant circuit each configured to control the temperature of a number of components of the vehicle, wherein the cooling system comprises a filling point for filling the first coolant circuit with coolant, and wherein the first coolant circuit comprises:

- a first coolant pump configured to pump coolant through the first coolant circuit,
- a conduit section connected to a pump inlet of the first coolant pump,
- a primer conduit connected to the conduit section and to the second coolant circuit, and
- a conduit portion located between the filling point and the pump inlet of the first coolant pump, wherein the conduit portion is arranged below the pump inlet of the first coolant pump as seen relative to a local gravity vector when the cooling system is arranged on the vehicle and the vehicle is positioned in an upright use position on a horizontal surface, and wherein the cooling system comprises a control arrangement according to some embodiments of the present disclosure.

Since the cooling system comprises a control arrangement according to some embodiments and the control arrangement is configured to initiate a supply of coolant from the second coolant circuit to the conduit section via the primer conduit during standstill of the first coolant pump, and then initiate operation of the first coolant pump, a cooling system is provided circumventing, or at least reducing the need for performing, a manual deaeration of the first coolant circuit.

This is because the supply of coolant from the second coolant circuit to the conduit section via the primer conduit can ensure that the pump inlet of the first coolant pump is supplied with coolant before operation of the first coolant pump is initiated.

Furthermore, since the first coolant circuit comprises the conduit portion arranged between the filling point and the pump inlet, wherein the conduit portion is arranged below the pump inlet of the first coolant pump as seen relative to the local gravity vector, it cannot be ensured that the pump inlet of the first coolant pump is filled with coolant when coolant is filled into the filling point of the cooling system. This is because air in the first coolant circuit downstream of the conduit portion may create an airlock which prevents a flow of coolant from the filling point to the pump inlet of the first coolant pump. That is, due to the conduit portion arranged below the pump inlet, coolant is hindered from flowing naturally, i.e., by gravity, continuously downwards from the filling point to the pump inlet. Moreover, air cannot naturally, i.e., by gravity, move up continuously from the pump inlet to the filling point.

However, since the control arrangement of the cooling system is configured to initiate the supply of coolant from the second coolant circuit to the conduit section via the primer conduit, it can be ensured that the pump inlet of the first coolant pump is supplied with coolant before operation of the first coolant pump is initiated despite the fact that the first coolant circuit comprises the conduit portion arranged below the pump inlet of the first coolant pump as seen relative to the local gravity vector.

Moreover, the cooling system provides conditions for more freedom in the vertical placement of the first coolant pump relative to other parts of the cooling system while ensuring that the pump inlet of the first coolant pump is supplied with coolant before initiating operation of the first coolant pump. For example, a cooling system is provided in which the first coolant pump can be arranged at a higher position than a coolant level of the second coolant circuit as seen relative to a local gravity vector when the vehicle comprising the cooling system is positioned in an upright use position on a horizontal surface, while ensuring that the pump inlet of the first coolant pump is supplied with coolant before initiating operation of the first coolant pump. In this manner, a cooling system is provided having conditions for reduced packing problems and facilitated routing and placement of conduits and other parts of the cooling system.

In addition, since the need for performing a manual deaeration of the first coolant circuit is circumvented, or at least reduced, a cooling system is provided having conditions for reducing assembly costs, service, repair, and maintenance costs, as well as operational costs of vehicles. This is because the cooling system provides conditions for filling the first coolant circuit with coolant from the second coolant circuit instead of preforming a manual deaeration of the first coolant circuit.

Moreover, a cooling system is provided capable of reducing the risk of damage of the first coolant pump and the number of components of the vehicle being temperature controlled by the first coolant circuit. As a further result, a cooling system is provided capable of reducing the risk of vehicle standstills due to an insufficient supply of coolant to the first coolant pump of the first coolant circuit.

Accordingly, a cooling system is provided overcoming, or at least alleviating, at least some of the above-mentioned problems and drawbacks. As a result, the above-mentioned object is achieved.

Optionally, the conduit section comprises at least one portion arranged at a higher position than the pump inlet of the first coolant pump as seen relative to the local gravity vector when the cooling system is arranged on the vehicle and the vehicle is positioned in an upright use position on a horizontal surface. Thereby, a cooling system is provided capable of further reducing the risk of damage of the first coolant pump and the number of components of the vehicle being temperature controlled by the first coolant circuit caused by an insufficient supply of coolant to the first coolant pump. This is because the least one portion, arranged at a higher position than the pump inlet of the first coolant pump, can act as an air trap for trapping air if present in the conduit section.

Optionally, the first coolant circuit is configured to control the temperature of a number of sets of propulsion battery cells. Thereby, a cooling system is provided capable of controlling the temperature of a number of sets of propulsion battery cells while circumventing, or at least reducing the need for performing, a manual deaeration of the first coolant circuit. Moreover, a cooling system is provided capable of controlling the temperature of a number of sets of propulsion battery cells while having conditions for reduced packing problems and facilitated routing and placement of conduits and other parts of the cooling system.

Optionally, the second coolant circuit comprises a coolant distribution manifold, and wherein the cooling system comprises at least two further coolant circuits each configured to exchange coolant in the coolant distribution manifold, and wherein the second coolant circuit is a temperature conditioning circuit configured to regulate the temperature of the coolant in the coolant distribution manifold. Thereby, a cooling system is provided having conditions for being compact and efficient. Moreover, a cooling system is provided allowing for an individual control of the flow rate through each one of the at least two further coolant circuits without any significant risk of flow disturbances, such as back flows or zero flow situations, in the manifold or in the cooling system.

Optionally, the first coolant circuit exchanges coolant in the coolant distribution manifold. Thereby, a cooling system is provided having conditions for being compact and efficient. Moreover, a cooling system is provided allowing for an individual control of the flow rate through the first coolant circuit without any significant risk of flow disturbances, such as back flows or zero flow situations, in the manifold or in the cooling system. In addition, a cooling system is provided having conditions for deaerate the first coolant circuit in an efficient manner via the coolant distribution manifold.

Optionally, each of the at least two further coolant circuits is configured to control the temperature of a respective set of propulsion battery cells. Thereby, a cooling system is provided capable of controlling the temperature of a number of sets of propulsion battery cells in an efficient manner while circumventing, or at least reducing the need for performing, a manual deaeration of the first coolant circuit. Moreover, a cooling system is provided capable of controlling the temperature of a number of sets of propulsion battery cells while having conditions for reduced packing problems and facilitated routing and placement of conduits and other parts of the cooling system.

According to a sixth aspect of the invention, the object is achieved by a vehicle comprising a number of first components, a number of second components, and a cooling system according to some embodiments of the present disclosure, wherein the first coolant circuit is configured to control the temperature of the number of first components and the second coolant circuit is configured to control the temperature of the number of second components, and wherein the conduit portion of the first coolant circuit is arranged below the pump inlet of the first coolant pump as seen relative to a local gravity vector when the vehicle is positioned in an upright use position on a horizontal surface.

Since the vehicle comprises a cooling system according to some embodiments, a vehicle is provided overcoming, or at least alleviating, at least some of the above-mentioned problems and drawbacks. As a result, the above-mentioned object is achieved.

Optionally, the number of first components is/are arranged at a higher position than the number of second components as seen relative to a local gravity vector when the vehicle is positioned in an upright use position on a horizontal surface. Thereby, a vehicle is provided in which each of the number of first and second components can be temperature controlled in an efficient manner, while circumventing, or at least reducing the need for performing, a manual deaeration of the first coolant circuit.

Further features of, and advantages with, the present invention will become apparent when studying the appended claims and the following detailed description.

BRIEF DESCRIPTION OF THE DRAWINGS

Various aspects of the invention, including its particular features and advantages, will be readily understood from the example embodiments discussed in the following detailed description and the accompanying drawings, in which.

DETAILED DESCRIPTION

Aspects of the present invention will now be described more fully. Like numbers refer to like elements throughout. Well-known functions or constructions will not necessarily be described in detail for brevity and/or clarity.

Figure 1:
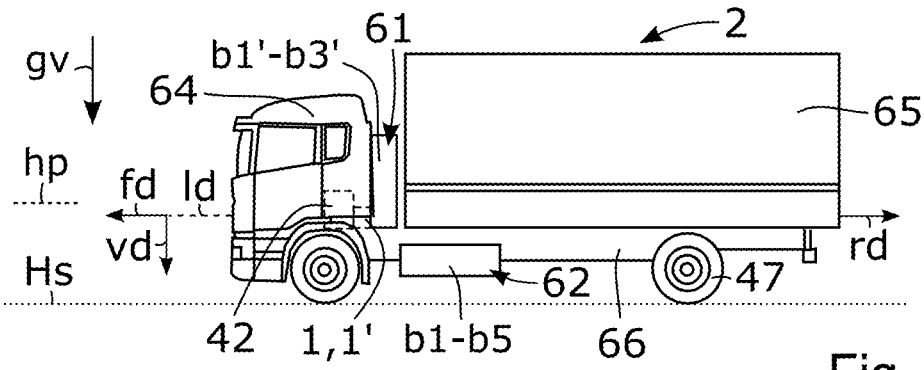
FIG. 1 schematically illustrates a vehicle according to some embodiments.

FIG. 1 schematically illustrates a vehicle 2, according to some embodiments of the present disclosure. According to the illustrated embodiments, the vehicle 2 is a truck, i.e., a type of heavy vehicle. According to further embodiments, the vehicle 2, as referred to herein, may be another type of heavy or lighter type of manned or unmanned vehicle for land or water-based propulsion such as a lorry, a bus, a construction vehicle, a tractor, a car, a ship, a boat, or the like.

The vehicle 2 comprises a powertrain 42. According to the illustrated embodiments, the powertrain 42 is configured to provide motive power to the vehicle 2 via wheels 47 of the vehicle 2. Moreover, according to the illustrated embodiments, the powertrain 42 comprises an electric propulsion motor, wherein the electric propulsion motor is capable of providing motive power to the vehicle 2 via wheels 47 of the vehicle 2 as well as providing regenerative braking of the vehicle 2. Thus, according to the illustrated embodiments, the electric propulsion motor is capable of operating as an electric motor as well as an electric generator. The electric propulsion motor of the vehicle 2 may also be referred to as a vehicle propulsion motor/generator.

According to the illustrated embodiments, the powertrain 42 of the vehicle 2 is a pure electric powertrain 42, i.e., a powertrain comprising no internal combustion engine. According to further embodiments, the powertrain 42 of the vehicle 2 may be a so-called hybrid electric powertrain 42 comprising a combustion engine in addition to the electric propulsion motor for providing motive power to the vehicle 2. Moreover, according to further embodiments, the powertrain 42 of the vehicle 2 may comprise a combustion engine as the only source of power for providing motive power to the vehicle 2.

In FIG. 1, the vehicle 2 is illustrated as positioned onto a flat horizontal surface Hs in an intended use position. Moreover, in FIG. 1, a vertical direction vd of the vehicle 2 is indicated. The vertical direction vd of the vehicle 2 is perpendicular to the flat horizontal surface Hs when the vehicle 2 is positioned thereon in the intended use position. Moreover, the vertical direction vd of the vehicle 2 coincides with the direction of a local gravity vector gv at the location of the vehicle 2 when the vehicle 2 positioned onto a flat horizontal surface Hs in an intended use position.

As can be seen in FIG. 1, the wheels 47 of the vehicle 2 are abutting the flat horizontal surface Hs when the vehicle 2 is positioned in the intended upright use position on the flat horizontal surface Hs. The vehicle 2 has a longitudinal direction Id. The longitudinal direction Id of the vehicle 2 is parallel to the flat horizontal surface Hs when the vehicle 2 is positioned in the intended upright use position thereon. Moreover, the longitudinal direction Id of the vehicle 2 is parallel to a forward moving direction fd of the vehicle 2 as well as to a reverse moving direction rd of the vehicle 2. The reverse moving direction rd of the vehicle 2 is opposite to the forward moving direction fd of the vehicle 2. Furthermore, in FIG. 1, a horizontal plane hp is indicated. The horizontal plane hp is parallel to the horizontal surface Hs, and thus also parallel to the longitudinal direction Id of the vehicle 2 when the vehicle 2 is positioned in an upright use position on the horizontal surface Hs.

The vehicle 2 comprises a number of first components b1'-b3' and a number of second components b1-b5 as well as a cooling system 1, 1'. As is further explained herein, the cooling system 1, 1' of the vehicle 2 is configured to control the temperature of number of first components b1'-b3' and the number of second components b1-b5. According to the illustrated embodiments, the number of first components b1'-b3' form part of a first propulsion battery pack 61 and the number of second components b1-b5 form part of a second propulsion battery pack 62, wherein each of the first and second propulsion battery packs 61, 62 is configured to provide electricity to the electric propulsion motor of the powertrain 42 of the vehicle 2.

According to further embodiments, each of the number of first components b1'-b3' and the number of second components b1-b5 may be, or may form part of, another type of system or component of the vehicle 2, such as a combustion engine, an electric propulsion system, an electric propulsion motor, power electronics, a propulsion battery, a retarder, a waste heat recovery circuit, or the like.

As seen in FIG. 1, according to the illustrated embodiments, the number of first components b1'-b3' is arranged at a higher position on the vehicle 2 than the number of second components b1-b5 as seen relative to the local gravity vector gv when the vehicle 2 is positioned in an upright use position on a horizontal surface Hs. In other words, the number of first components b1'-b3' is arranged at a higher position on the vehicle 2 than the number of second components b1-b5 as seen relative to the vertical direction vd of the vehicle 2.

In more detail, according to the illustrated embodiments, the first propulsion battery pack 61, comprising the number of first components b1'-b3', is arranged behind a cab 64 of the vehicle 2 and in front of a cargo compartment 65 of the vehicle 2 as seen relative to the forward moving direction fd of the vehicle. The first propulsion battery pack 61 may be attached to a frame 66 of the vehicle 2 at a position close to and behind the cab 64 as seen relative to the forward moving direction fd of the vehicle 2.

Moreover, according to the illustrated embodiments, the second propulsion battery pack 62 is attached to the frame 66 of the vehicle 2 at a position below the cargo compartment 65 of the vehicle 2 as seen relative to the vertical direction vd of the vehicle 2. According to further embodiments, the first and second battery packs 61, 62 may each be arranged at another position of the vehicle 2 than depicted in FIG. 1, and/or may be attached to the vehicle 2 in another manner than described above.

Figure 2:
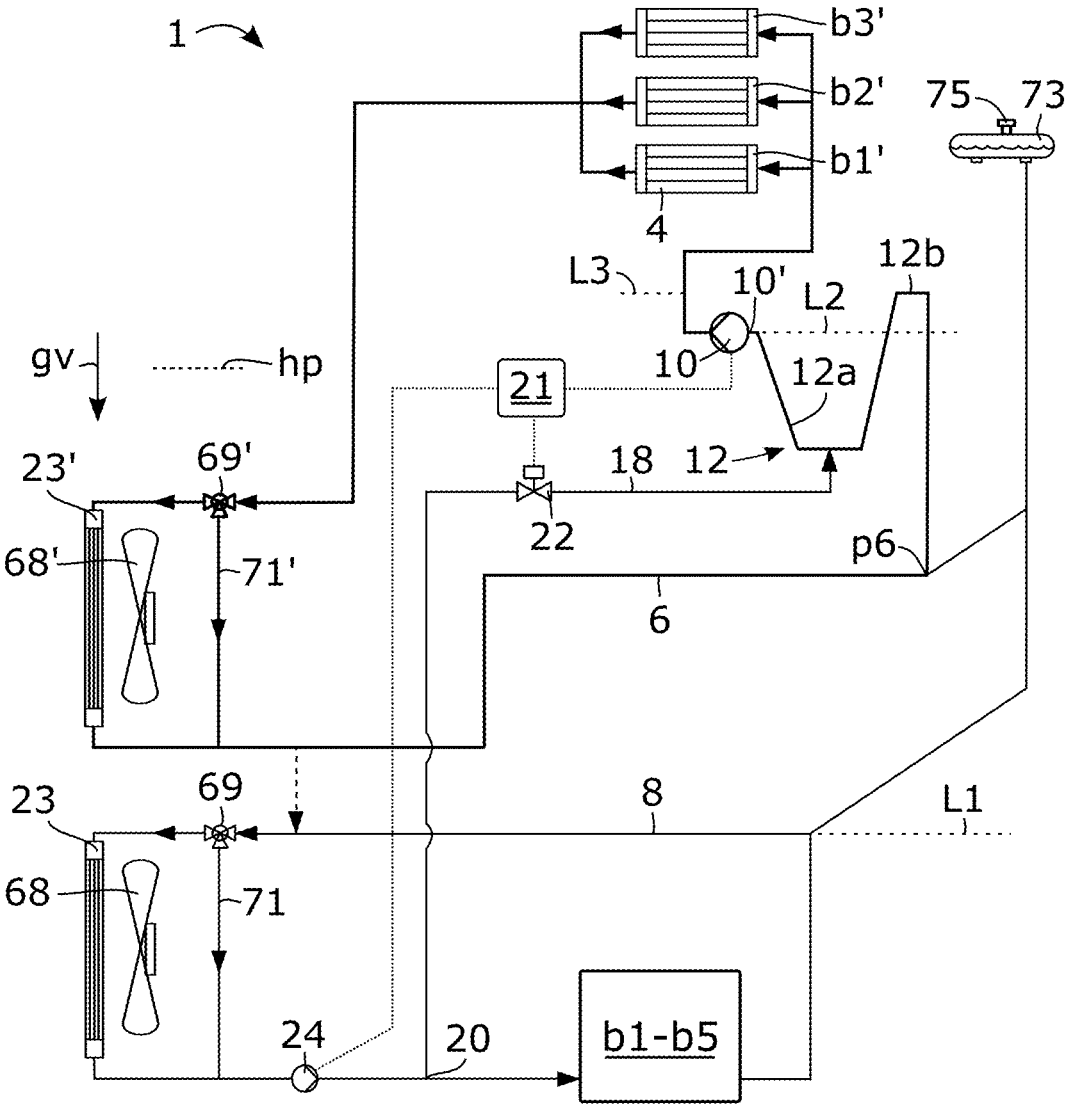
FIG. 2 schematically illustrates a cooling system according to some embodiments, FIG. 3 schematically illustrates a cooling system according to some further embodiments, FIG. 4 schematically illustrates a method of operating a cooling system of a vehicle, FIG. 5*a* schematically illustrates a first timeline indicating some of the steps of the method according to some embodiments, FIG. 5*b* schematically illustrates a second timeline indicating some of the steps of the method according to some embodiments.

FIG. 2 schematically illustrates a cooling system 1 according to some embodiments of the present disclosure. The cooling system 1 comprises a first and a second coolant circuit 6, 8 each configured to control the temperature of a number of components b1', b2', b3', b1-b5 of a vehicle. The vehicle may be a vehicle 2 according to the embodiments illustrated in FIG. 1. In other words, the vehicle 2 illustrated in FIG. 1 may comprise a cooling system 1 according to the embodiments illustrated in FIG. 2. Therefore, below, simultaneous reference is made to FIG. 1-FIG. 2, if not indicated otherwise.

In more detail, according to the illustrated embodiments, the first coolant circuit 6 of the cooling system 1 is configured to control the temperature of the number of first components b1', b2', b3' and the second coolant circuit 8 of the cooling system 1 is configured to control the temperature of the number of second components b1-b5 of the vehicle 2. The reference sign for the number of first components b1', b2', b3' is in some places herein abbreviated b1'-b3' for reasons of brevity and clarity.

According to the illustrated embodiments, the number of first components b1'-b3' is a number of sets b1'-b3' of propulsion battery cells 4. In other words, according to the illustrated embodiments, the first coolant circuit 6 is configured to control the temperature of a number of sets b1'-b3' of propulsion battery cells 4. In FIG. 2, the reference sign "4" is indicated only at the set b1' of propulsion battery cells 4 provided with the reference sign "b1" for the reason of brevity and clarity.

Moreover, each set b1'-b3' of propulsion battery cells 4 may form part of a propulsion battery pack, as is the case according to the embodiments illustrated in FIG. 2. That is, according to the embodiments illustrated in FIG. 2, each set b1'-b3' of propulsion battery cells 4 forms part of the first battery pack 61 illustrated in FIG. 1, wherein each set b1'-b3' of propulsion battery cells 4 is configured to supply electricity to a propulsion motor of a vehicle 2. According to further embodiments, a set b1'-b3' of propulsion battery cells 4, as referred to herein, may comprise battery cells 4 of two or more propulsion battery packs, battery cells 4 of a propulsion battery having a certain voltage, battery cells 4 of a portion of a propulsion battery pack, or the like.

Moreover, according to the illustrated embodiments, the number of second components b1-b5 is a number of sets b1-b5 of propulsion battery cells 4. In other words, according to the illustrated embodiments, the second coolant circuit 8 is configured to control the temperature of a number of sets b1-b5 of propulsion battery cells 4. Each set b1-b5 of propulsion battery cells 4 may form part of a propulsion battery pack, as is the case according to the embodiments illustrated in FIG. 2. That is, according to the embodiments illustrated in FIG. 2, each set b1-b5 of propulsion battery cells 4 forms part of the second battery pack 62 illustrated in FIG. 1. According to further embodiments, a set b1-b5 of propulsion battery cells 4, as referred to herein, may comprise battery cells 4 of two or more propulsion battery packs, battery cells 4 of a propulsion battery having a certain voltage, battery cells 4 of a portion of a propulsion battery pack, or the like.

The cooling system 1 comprises a filling point 75 for filling the first coolant circuit 6 with coolant. That is, in more detail, according to the illustrated embodiments, the cooling system 1 comprises an expansion vessel 73 fluidly connected to each of the first and second coolant circuit 6, 8. The expansion vessel 73 is arranged to handle differences in the volume of coolant in the cooling system 1, i.e., in the first and second coolant circuits 6, 8 respectively. According to further embodiments, the expansion vessel may be fluidly connected to the first coolant circuit 6 only.

According to the illustrated embodiments, the filling point 75, as referred to herein, is a filling opening of the expansion vessel 73. The filling opening is covered by an expansion vessel lid, which can be removed when filling the first coolant circuit 6 with coolant. Since the filling point 75 according to the illustrated embodiments is a filling opening of the expansion vessel 73, the filling point 75 can be used to fill coolant into each of the first and second coolant circuit 6, 8. According to further embodiments, the filling point 75, as referred to herein, may be another type of filling point for filling the first coolant circuit 6 with coolant, such as another type of opening or valve assembly.

The first coolant circuit 6 comprises a first coolant pump 10 configured to pump coolant through the first coolant circuit 6. The first coolant circuit 6 further comprises a first heat exchanger 23', in the form of a radiator configured to transfer heat from the first coolant circuit 6 to ambient air. The first heat exchanger 23' may be arranged at a front section of the vehicle 2 comprising the cooling system 1 to be subjected to an airflow during movement of the vehicle 2 in the forward moving direction fd. Moreover, the cooling system 1 may comprise a fan assembly 68' configured to selectively generate an airflow through the first heat exchanger 23'. Furthermore, according to the illustrated embodiments, the first coolant circuit 6 comprises a thermostat assembly 69' and a bypass line 71' bypassing the first heat exchanger 23', wherein the thermostat assembly 69' is configured to direct coolant to the first heat exchanger 23' or to the bypass line 71', for example based on the temperature of coolant in the first coolant circuit 6.

The second coolant circuit 8 comprises a second coolant pump 24 configured to pump coolant through the second coolant circuit 8. The second coolant circuit 8 further comprises a second heat exchanger 23, in the form of a radiator configured to transfer heat from the second coolant circuit 8 to ambient air. The second heat exchanger 23 may be arranged at a front section of the vehicle 2 comprising the cooling system 1 to be subjected to an airflow during movement of the vehicle 2 in the forward moving direction fd. Moreover, the cooling system 1 may comprise a fan assembly 68 configured to selectively generate an airflow through the second heat exchanger 23. Furthermore, according to the illustrated embodiments, the second coolant circuit 8 comprises a thermostat assembly 69 and a bypass line 71 bypassing the second heat exchanger 23, wherein the thermostat assembly 69 is configured to direct coolant to the second heat exchanger 23 or to the bypass line 71, for example based on the temperature of coolant in the second coolant circuit 8.

The first coolant pump 10 comprises a pump inlet 10'. The pump inlet 10' of the first coolant pump 10, as referred to herein, is a structural portion of the first coolant pump 10. The first coolant pump 10 is configured to pump coolant from the pump inlet 10' to a pump outlet of the first coolant pump 10 during operation. The pump outlet of the first coolant pump 10 is fluidly connected to the number of first components b1'-b3' of the vehicle 2. The pump outlet of the first coolant pump 10 is not indicated with a reference sign in FIG. 2 for reasons of brevity and clarity.

The first coolant circuit 6 further comprises a conduit section 12 connected to the pump inlet 10' of the first coolant pump 10. Moreover, the first coolant circuit 6 comprises a primer conduit 18 connected to the conduit section 12 and to the second coolant circuit 8. The primer conduit 18, as referred to herein, may be comprised in the cooling system 1.

In FIG. 2, the cooling system 1 is illustrated as arranged on the vehicle 2 wherein the vehicle 2 is positioned in an upright use position on a horizontal surface Hs. The horizontal plane hp illustrated in FIG. 2 is thus parallel to the horizontal plane hp illustrated in FIG. 1. Likewise, the local gravity vector gv illustrated in FIG. 2 is parallel to the local gravity vector gv illustrated in FIG. 1. The local gravity vector gv, as referred to herein, is representative of a local gravity vector gv at the location of the cooling system 1. The horizontal plane hp is perpendicular to the local gravity vector gv, i.e., the normal to the horizontal plane hp is parallel to the local gravity vector gv. The components of the cooling system 1 are configured to be mounted in an Intended mounting position on a vehicle 2. In FIG. 2, the components of the cooling system 1 are illustrated in a position corresponding to an intended mounting position thereof.

As seen in FIG. 2, the second coolant circuit 8 comprises no conduit portions being arranged below the second coolant pump 24 as seen relative to the local gravity vector gv in a flow path from the filling point 75 and the second coolant pump 24. In this manner, it is ensured that the pump inlet of the second coolant pump 24 is filled with coolant when coolant is filled into the filling point 75 of the cooling system 1.

However, as can be seen in FIG. 2, the first coolant circuit 6 comprises a conduit portion p6 located in a flow path between the filling point 75 and the pump inlet 10' of the first coolant pump 10, wherein the conduit portion p6 is arranged below the pump inlet 10' of the first coolant pump 10 as seen relative to a local gravity vector gv. Since the conduit portion p6 is located between the filling point 75 and the pump inlet 10', and is arranged below the pump inlet 10' of the first coolant pump 10, it cannot be ensured that the pump inlet 10' of the first coolant pump 10 is filled with coolant when coolant is filled into the filling point 75 of the cooling system 1.

This is because air in the first coolant circuit 6 downstream of the conduit portion p6 may create an airlock which prevents a flow of coolant from the filling point 75 to the pump inlet 10' of the first coolant pump 10. That is, due to the conduit portion p6 arranged below the pump inlet 10' of the first coolant pump 10, coolant is hindered from flowing naturally, i.e., by gravity, continuously downwards from the filling point 75 to the pump inlet 10' of the first coolant pump 10. Moreover, air cannot naturally, i.e., by gravity, move up continuously from the pump inlet 10' of the first coolant pump 10 to the filling point 75. Furthermore, the first coolant circuit 6 comprises no other conduit where coolant naturally, i.e., by gravity, can flow continuously downwards to the pump inlet 10' from the filling point, or a conduit where air naturally, i.e., by gravity, can move up continuously from the pump inlet 10' to the filling point 75. Therefore, a filling of coolant into the filling point 75 with a subsequent operation of the pump inlet 10' of the first coolant pump 10 may not result in a complete filling and deaeration of the first coolant circuit 6.

In FIG. 2, the filling point 75, as well as the expansion vessel 73 comprising the filling point 75, is arranged above the pump inlet 10' of the first coolant pump 10, as seen relative to a local gravity vector gv when the cooling system 1 is arranged on the vehicle 2 and the vehicle 2 is positioned in an upright use position on a horizontal surface Hs. However, an airlock may prevent a flow of coolant from the filling point 75 to the pump inlet 10' of the first coolant pump 10 in the above described manner regardless of whether the filling point 75, and/or the expansion vessel 73, is arranged above or below the pump inlet 10' of the first coolant pump 10 as seen relative to the local gravity vector gv. This is because all portions of the first coolant circuit 6 above the pump inlet 10' of the first coolant pump 10 are closed circuit portions and because the first coolant circuit 6 comprises no other conduit where coolant naturally, i.e., by gravity, can flow continuously downwards to the pump inlet 10' from the filling point, or a conduit where air naturally, i.e., by gravity, can move up continuously from the pump inlet 10' to the filling point 75.

The feature that the conduit portion p6 is located between the filling point 75 and the pump inlet 10' of the first coolant pump 10 means that the conduit portion p6 is located, i.e., is arranged, in a flow path between the filling point 75 and the pump inlet 10' of the first coolant pump 10.

The feature that the conduit portion p6 is arranged below the pump inlet 10' of the first coolant pump 10 as seen relative to a local gravity vector gv means that the conduit portion p6 is arranged below the first coolant pump 10 as seen relative to a local gravity vector gv when the cooling system 1 is arranged on the vehicle 2 and the vehicle 2 is positioned in an upright use position on a horizontal surface Hs. This is because the pump inlet 10' of the first coolant pump 10 is a structural portion of the first coolant pump 10 according to the illustrated embodiments.

Moreover, the feature that the conduit portion p6 is arranged below the first coolant pump 10 as seen relative to a local gravity vector gv when the cooling system 1 is arranged on the vehicle 2 and the vehicle 2 is positioned in an upright use position on a horizontal surface Hs means that the conduit portion p6 is arranged below the first coolant pump 10 as seen relative to the vertical direction vd of the vehicle 2.

As can be seen in FIG. 2, according to the illustrated embodiments, the pump inlet 10' of the first coolant pump 10 is arranged at a higher position than a coolant level L1 of the second coolant circuit 8 as seen relative to the local gravity vector gv when the cooling system 1 is arranged on the vehicle 2 and the vehicle 2 is positioned in an upright use position on a horizontal surface Hs. The coolant level L1 of the second coolant circuit 8 as referred to herein may be an intended coolant level L1 of the second coolant circuit 8, i.e., a coolant level L1 to which the second coolant circuit 8 is intended to be filled with coolant before operating the second coolant circuit 8.

The feature that the pump inlet 10' of the first coolant pump 10 is arranged at a higher position than a coolant level L1 of the second coolant circuit 8 means that the first coolant pump 10 is arranged at a higher position than a coolant level L1 of the second coolant circuit 8 when the cooling system 1 is arranged on the vehicle 2 and the vehicle 2 is positioned in an upright use position on a horizontal surface Hs. This is because the pump inlet 10' of the first coolant pump 10 is a structural portion of the first coolant pump 10 according to the illustrated embodiments.

Moreover, the feature that the pump inlet 10' of the first coolant pump 10 is arranged at a higher position than the coolant level L1 of the second coolant circuit 8 when the cooling system 1 is arranged on the vehicle 2 and the vehicle 2 is positioned in an upright use position on a horizontal surface Hs means that the pump inlet 10' of the first coolant pump 10 is arranged at a higher position than the coolant level L1 of the second coolant circuit 8 as seen relative to the vertical direction vd of the vehicle 2.

The cooling system 1 further comprises a control arrangement 21. As is further explained herein, the control arrangement 21 is configured to initiate a supply of coolant from the second coolant circuit 8 to the conduit section 12 via the primer conduit 18 during standstill of the first coolant pump 10, and then initiate operation of the first coolant pump 10. In this manner, the need for performing a manual deaeration of the first coolant circuit 6 is circumvented or is at least reduced. Moreover, the control performed by the control arrangement 21 of the cooling system 1 provides conditions for more freedom in the vertical placement of the first coolant pump 10 relative to other parts of the cooling system 1 while ensuring that the pump inlet 10' of the first coolant pump 10 is supplied with coolant before initiating operation of the first coolant pump 10. As an example, due to the control performed by the control arrangement 21 of the cooling system 1, the first coolant pump 10 is allowed to be arranged above the coolant level L1 of the second coolant circuit 8 without risking an insufficient supply of coolant to the pump inlet 10' of the first coolant pump 10 during start-up of the first coolant pump 10.

According to the illustrated embodiments, the primer conduit 18 is connected to a pressure portion 20 of the second coolant circuit 8. The wording pressure portion 20 means that the fluid pressure of the pressure portion 20 is higher than an average fluid pressure in the second coolant circuit 8. According to the illustrated embodiments, the primer conduit 18 of the cooling system 1 is connected to a pressure portion 20 of the second coolant circuit 8 located downstream of the second coolant pump 24. In more detail, according to the illustrated embodiments, the pressure portion 20 is located downstream of the second coolant pump 24 and upstream of the number of second components b1-b5 as seen relative the direction of coolant flow in the second coolant circuit 8 during operation of the second coolant pump 24.

Moreover, according to the illustrated embodiments, the cooling system 1 comprises a valve 22 controllable between an open state, in which the valve 22 allows flow of coolant through the primer conduit 18, and a closed state, in which the valve 22 blocks flow of coolant through the primer conduit 18. According to the illustrated embodiments, the control arrangement 21 is configured to initiate the supply of coolant from the second coolant circuit 8 to the conduit section 12 via the primer conduit 18 by controlling the valve 22 to the open state.

Moreover, according to the illustrated embodiments, the control arrangement 21 is configured to initiate the supply of coolant from the second coolant circuit 8 to the conduit section 12 by operating the second coolant pump 24. However, according to further embodiments, the second coolant pump 24 may be operated by another device, arrangement, or system than the control arrangement 21 depicted in FIG. 2.

Accordingly, due to these features, when the second coolant pump 24 is operating and the valve 22 is in the open state, the conduit section 12 can be filled with coolant from the second coolant circuit 8 via the primer conduit 18 by the pumping action of the second coolant pump 24 of the second coolant circuit 8.

In FIG. 2, a second and a third level L2, L3 are indicated. The second level L2 indicates a vertical height of the pump inlet 10' of the first coolant pump 10, i.e., a vertical height of the pump inlet 10' relative to the local gravity vector gv when the vehicle 2 is positioned in an upright use position on a horizontal surface Hs. As seen in FIG. 2, the second level L2 is higher than the coolant level L1 of the second coolant circuit 8 as seen relative to the vertical direction vd of the vehicle 2.

According to the illustrated embodiments, the conduit section 12 comprises at least one portion 12*b* arranged at a higher position than the pump inlet 10' of the first coolant pump 10 as seen relative to the local gravity vector gv when the cooling system 1 is arranged on the vehicle 2 and the vehicle 2 is positioned in an upright use position on a horizontal surface Hs. The third level L3 in FIG. 2 indicates the vertical height of a top portion of the at least one portion 12*b* of the conduit section 12. Since the at least one portion 12*b* is arranged at a higher position than the pump inlet 10' of the first coolant pump 10 as seen relative to the vertical direction vd of the vehicle 2, the at least one portion 12*b* can act as an air trap for trapping air, if present in the conduit section 12*b*, also after the conduit section 12 has been filled with coolant via the primer conduit 18.

The conduit section 12 further comprises a main portion 12*a* arranged between the at least one portion 12*b* and the pump inlet 10' of the first coolant pump 10. The main portion 12*a* of the conduit section 12 is arranged at and below the second level L2 referred to above. According to the illustrated embodiments, the primer conduit 18 is connected to the main portion 12*a* of the conduit section 12. However, according to further embodiments, the primer conduit 18 may be connected to another portion of the conduit section 12.

Moreover, according to the illustrated embodiments, the first coolant pump 10 is a centrifugal pump, i.e., a coolant pump allowing coolant flow through the pump also at standstill thereof.

During a filling procedure of coolant from the second coolant circuit 8 to the conduit section 12 via the primer conduit 18, air can pass through the first coolant pump 10 and the conduit section 12 of the first coolant circuit 6 can be filled with coolant to the level L3 indicated in FIG. 2. Thus, during such a filling procedure of coolant from the second coolant circuit 8 to the conduit section 12 via the primer conduit 18, coolant can be pumped, using the second coolant pump 24, to the conduit section 12 and through the first coolant pump 10 into a portion of an outlet duct of the first coolant pump 10 to the level L3 indicated in FIG. 2.

In this state, the at least one section 12*b* of the conduit section 12, the main section 12*a* of the conduit section 12, and the portion of the outlet duct of the first coolant pump 10 is filled with coolant to the level L3 indicated in FIG. 2. In this manner, operation of the first coolant pump 10 can be initiated without risking an insufficient supply of coolant to the pump inlet 10' of the first coolant pump 10. Moreover, any remaining air, if present, can be trapped in the at least one section 12*b* of the conduit section 12 during the filling procedure as well as when operation of the first coolant pump 10 has been initiated.

Figure 3:
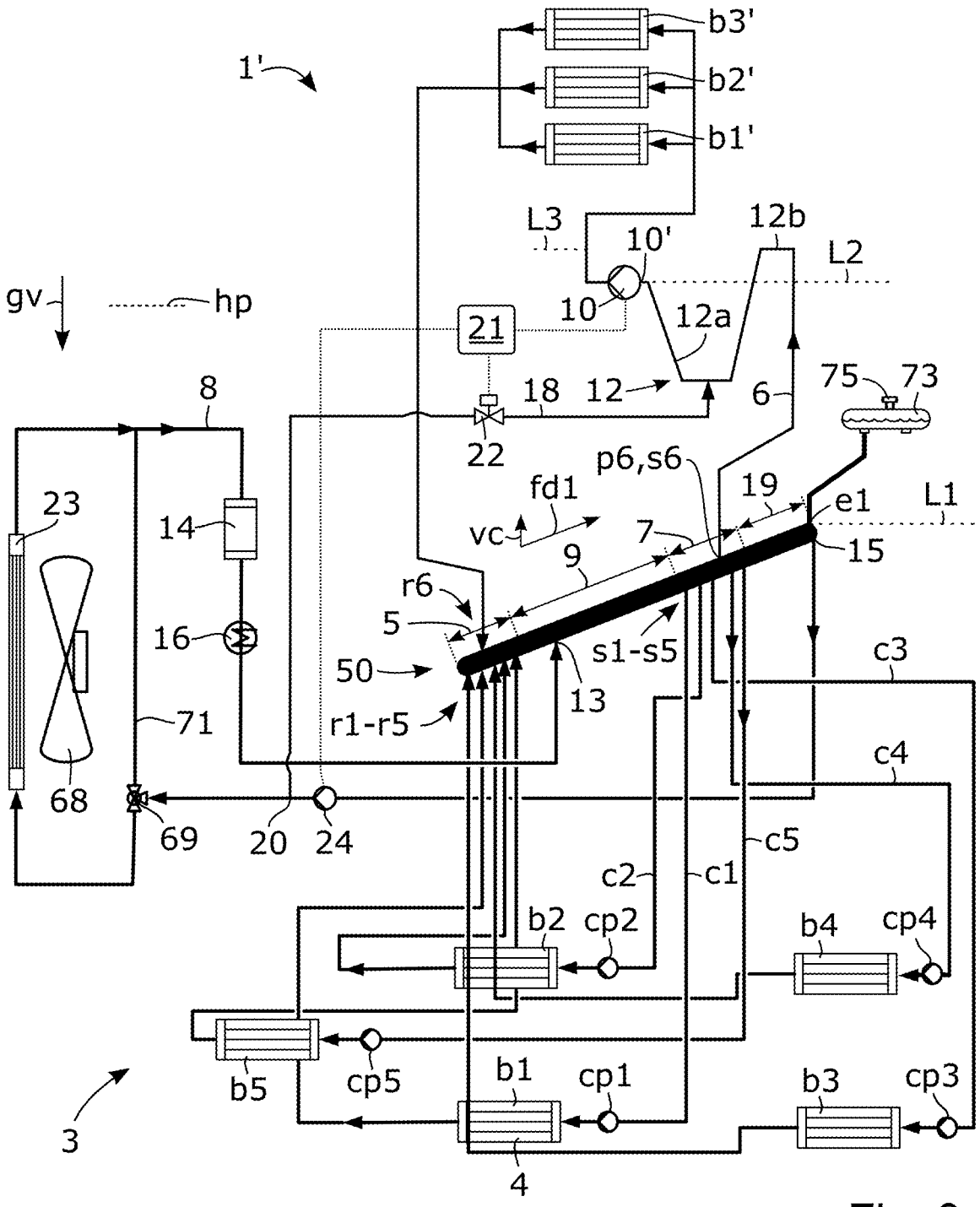

FIG. 3 schematically illustrates a cooling system 1' according to some further embodiments of the present disclosure. The cooling system 1' comprises a first and a second coolant circuit 6, 8 each configured to control the temperature of a number of components b1'-b3', b1-b5 of a vehicle. The vehicle may be a vehicle 2 according to the embodiments illustrated in FIG. 1. In other words, the vehicle 2 illustrated in FIG. 1 may comprise a cooling system 1' according to the embodiments illustrated in FIG. 3. Therefore, below, simultaneous reference is made to FIG. 1 and FIG. 3, if not indicated otherwise.

According to the embodiments illustrated in FIG. 3, the second coolant circuit 8 of the cooling system 1' comprises a coolant distribution manifold 50. Moreover, the cooling system 1' comprises at least two further coolant circuits c1-c5 each configured to exchange coolant in the coolant distribution manifold 50. Furthermore, as is explained in greater detail below, according to the embodiments illustrated in FIG. 3, the second coolant circuit 8 is a temperature conditioning circuit configured to regulate the temperature of the coolant in the coolant distribution manifold 50.

The cooling system 1' illustrated in FIG. 3 is configured to regulate the temperature of a number of sets b1'-b3', b1-b5' of propulsion battery cells 4. The reference signs for the sets b1', b2', b3', b1, b2, b3, b4, b5' of propulsion battery cells 4 are abbreviated "b1'-b3', b1-b5" in some places herein for reasons of brevity and clarity. Each set b1'-b3', b1-b5' of propulsion battery cells 4 is configured to supply electricity to a propulsion motor of a vehicle 2 comprising the propulsion battery b1-b5. In FIG. 3, the reference sign "4" is indicated only at the propulsion battery b1 provided with the reference sign "b1" for the reason of brevity and clarity. According to the illustrated embodiments, the cooling system 1' is configured to regulate the temperature of eight sets b1'-b3', b1-b5' of propulsion battery cells 4.

According to embodiments herein, the cooling system 1' comprises at least two further coolant circuits c1, c2, c3, c4, c5 each configured to control the temperature of a respective set b1-b5 of propulsion battery cells 4. The reference signs for the further coolant circuits c1, c2, c3, c4, c5 are abbreviated "c1-c5" in some places herein for reasons of brevity and clarity. According to the illustrated embodiments, the cooling system 1' comprises five further coolant circuits c1-c5 each configured to cool a respective set b1-b5 of propulsion battery cells 4. As indicated herein, the cooling system 1' may comprise another number of further coolant circuits c1-c5, such as three, four, six, seven, eight, nine, ten, or the like, wherein each further coolant circuit c1-c5 is configured to cool a respective set b1-b5 of propulsion battery cells 4.

Each set b1-b5 of propulsion battery cells 4 may form part of a propulsion battery pack, as is the case according to the embodiments illustrated in FIG. 3. That is, according to the embodiments illustrated in FIG. 3, each set b1-b5 of propulsion battery cells 4 forms part of the second battery pack 62 illustrated in FIG. 1. According to further embodiments, a set b1-b5 of propulsion battery cells 4, as referred to herein, may comprise battery cells 4 of two or more propulsion battery packs, battery cells 4 of a propulsion battery having a certain voltage, battery cells 4 of a portion of a propulsion battery pack, or the like.

As indicated above, according to the embodiments illustrated in FIG. 3, the second coolant circuit 8 is a temperature conditioning circuit configured to regulate the temperature of the coolant in the coolant distribution manifold 50. The second coolant circuit 8 is a coolant circuit capable of providing heated and/or cooled coolant, as is further explained herein. According to the illustrated embodiments, the second coolant circuit 8 comprises a second coolant pump 24. The second coolant pump 24 is configured to pump coolant through the second coolant circuit 8.

Moreover, the second coolant circuit 8 comprises a heat exchanger 23 in the form of a radiator configured to transfer heat from the second coolant circuit 8 to ambient air. The second heat exchanger 23 may be arranged at a front section of the vehicle 2 comprising the cooling system 1' to be subjected to an airflow during movement of the vehicle 2 in the forward moving direction fd. Moreover, the cooling system 1' may comprise a fan assembly 68 configured to selectively generate an airflow through the second heat exchanger 23. Furthermore, according to the illustrated embodiments, the second coolant circuit 8 comprises a thermostat assembly 69 and a bypass line 71 bypassing the second heat exchanger 23, wherein the thermostat assembly 69 is configured to direct coolant to the second heat exchanger 23 or to the bypass line 71, for example based on the temperature of coolant in the second coolant circuit 8.

According to the illustrated embodiments, the second coolant circuit 8 further comprises a cooler 14 and a heater 16. The cooler 14 is configured to cool coolant flowing through the second coolant circuit 8. The heater 16 is configured to heat coolant flowing through the second coolant circuit 8. The cooler 14 may comprise, or be in thermal contact with, an evaporator of a heat pump circuit. The heater 16 may comprise an electrical heater.

As mentioned, according to the embodiments illustrated in FIG. 3, the cooling system 1' comprises a coolant distribution manifold 50. The coolant distribution manifold 50 is in some places herein referred to as the "distribution manifold 50", or the "manifold 50", for the reason of brevity and clarity.

The coolant distribution manifold 50 comprises a coolant inlet 13. The coolant inlet 13 is configured to receive tempered coolant from the second coolant circuit 8. The coolant inlet 13, as referred to herein, may also be referred to as "the coolant temperature conditioning inlet 13". The manifold 50 further comprises a coolant outlet 15 configured to feed coolant to the second coolant circuit 8. The "coolant outlet 15", as referred to herein, may also be referred to as "the coolant temperature conditioning outlet 15".

The coolant distribution manifold 50 further comprises a receiving section 5. The receiving section 5 is configured to receive coolant from the at least two further coolant circuits c1-c5. That is, according to the illustrated embodiments, the receiving section 5 is configured to receive coolant from the five further coolant circuits c1-c5. The manifold 50 comprises the same number of receiving connections r1-r5 as the number of further coolant circuits c1-c5, wherein each receiving connection r1-r5 is arranged at the receiving section 5 of the manifold 50 and is connected to a respective further coolant circuit c1-c5.

The coolant distribution manifold 50 further comprises a supplying section 7. The supplying section 7 is configured to supply coolant to the at least two further coolant circuits c1-c5. That is, according to the illustrated embodiments, the supplying section 7 is configured to supply coolant to the five further coolant circuits c1-c5. Each supplying connection s1-s5 is arranged at the supplying section 7 of the manifold 50 and is connected to a respective further coolant circuit c1-c5.

The first coolant circuit 6 comprises a first coolant pump 10 configured to pump coolant through the first coolant circuit 6. The first coolant pump 10 comprises a pump inlet 10'. The pump inlet 10' of the first coolant pump 10, as referred to herein, is a structural portion of the first coolant pump 10. The first coolant pump 10 is configured to pump coolant from the pump inlet 10' to a pump outlet of the first coolant pump 10 during operation. The pump outlet of the first coolant pump 10 is fluidly connected to the number of first components b1'-b3' of the vehicle 2. The pump outlet of the first coolant pump 10 is not indicated with a reference sign in FIG. 3 for reasons of brevity and clarity.

According to the embodiments illustrated in FIG. 3, the first coolant circuit 6 comprises no heat exchanger, such as a radiator configured to be subjected to an airflow to transfer heat from the first coolant circuit 6. Instead, the pump inlet 10' of the first coolant pump 10 is fluidly connected to a supply connection s6 at the supplying section 7 of the coolant distribution manifold 50 via a conduit section 12 of the first coolant circuit 6. Moreover, the coolant distribution manifold 50 comprises a receiving connection r6 at the receiving section 5 of the coolant distribution manifold 50, wherein the first coolant circuit 6 is connected to the receiving connection r6 of the coolant distribution manifold 50.

Thus, according to the embodiments illustrated in FIG. 3, the first coolant pump 10 is configured to pump coolant from the supply connection s6 at the supplying section 7 of the coolant distribution manifold 50 via a conduit section 12 to the pump inlet 10' of the first coolant pump 10. Moreover, the first coolant pump 10 is configured to pump coolant through the sets b1', b2', b3' of propulsion battery cells 4 and into the receiving connection r6 at the receiving section 5 of the coolant distribution manifold 50 and through the coolant distribution manifold 50 to the supply connection s6 at the supplying section 7 of the coolant distribution manifold 50. In other words, according to the embodiments illustrated in FIG. 3, first coolant circuit 6 exchanges coolant in the coolant distribution manifold 50. In this manner, the first coolant circuit 6 can be deaerated in an efficient manner, as is further explained herein.

As can be seen in FIG. 3, the supplying section 7 is arranged downstream of the coolant inlet 13 relative to an intended flow direction fd1 through the manifold 50. Moreover, the supplying section 7 is arranged downstream of the receiving section 5 relative to the intended flow direction fd1 through the manifold 50. In this manner, coolant from the second coolant circuit 8 flowing into the manifold 50 via the coolant inlet 13 is mixed with the coolant from the further coolant circuits c1-c5 flowing into the receiving section 5 of the manifold 50 via the receiving connections r1-r5 and coolant from the first coolant circuit 6 flowing into the receiving section 5 of the manifold 50 via the receiving connection r6. Thereby, the coolant is tempered, i.e., is heated or cooled, before flowing out from the manifold 50 via the supplying connections s1-s6 of the supplying section 7 into the further coolant circuits c1-c5 and into the first coolant circuit 6.

The section 9 between the receiving section 5 and the supplying section 7 may be referred to as a mixing section 9 since coolant from the second coolant circuit 8 is mixed with the coolant from the further coolant circuits c1-c5 and from the first coolant circuit 6 in this section 9 of the manifold 50. Likewise, for the same reason, the "coolant distribution manifold 50", as referred to herein, may also be referred to as a "coolant mixing manifold 50", or a "coolant mixing/distribution manifold 50". The mixing section 9 has a certain length seen along the intended flow direction fd1 through the manifold 50. According to some embodiments, the length of the mixing section 9, measured in a direction coinciding with the intended flow direction fd1 through the manifold 50, is more than 20% of the length of the total flow path through the manifold 50 measured in a direction coinciding with the intended flow direction fd1 through the manifold 50.

The manifold 50 has a significantly greater flow cross sectional area than each of the receiving connections r1-r6 and the supplying connections s1-s6. In this manner, a low flow velocity of coolant is obtained through the coolant distribution manifold 50. Thereby, air entering the coolant distribution manifold 50 via the receiving connections r1-r6 can be removed in an efficient manner via a deairing connection e1 of the coolant distribution manifold 50, as is further explained herein.

As can be seen in FIG. 3, each of the further coolant circuits c1-c5 comprises a coolant pump cp1, cp2, cp3, cp4, cp5 configured to pump coolant through the respective further coolant circuit c1-c5. The reference signs for coolant pumps cp1, cp2, cp3, cp4, cp5 are abbreviated "cp1-cp5" in some places herein for reasons of brevity and clarity. Due to these features, the total cooling/heating power of the sets b1'-b3', b1-b5 of propulsion battery cells 4, cooled by the cooling system 1', can be regulated simply by regulating the temperature of the coolant in the second coolant circuit 8 and the flow rate of coolant pumped from the second coolant circuit 8 through the manifold 50.

Moreover, due to these features, the individual temperature of each set b1'-b3', b1-b5 of propulsion battery cells 4 can be regulated by performing individual control of the respective coolant pump cp1-cp5 of the respective further coolant circuit c1-c5 and an individual control of the first coolant pump 10. That is, due to the features of the manifold 50, the coolant pumps cp1-cp5, 10 can be controlled to provide different flow rates through different coolant circuits c1-c5, 6 without causing flow disturbances in the cooling system 1'. This because each further coolant circuit c1-c5, 6 is connected to the same volume of tempered coolant inside the manifold 50.

According to the illustrated embodiments, the coolant inlet 13 of the coolant distribution manifold 50 is arranged between the receiving section 5 and the supplying section 7 relative to the intended flow direction fd1 through the manifold 50. That is, according to the illustrated embodiments, the coolant inlet 13 is arranged at the mixing section 9. According to further embodiments, coolant inlet 13 may be arranged upstream of the receiving section 5 relative to the intended flow direction fd1, fd2 through the manifold 50. Furthermore, according to some embodiments, the coolant inlet 13 may be arranged at the receiving section 5. A great flexibility can be provided for the installation, connection, and routing of coolant conduits due to the different possible placements of the coolant inlet 13.

According to the illustrated embodiments, the coolant outlet 15 of the coolant distribution manifold 50, connected to the second coolant circuit 8, is arranged downstream of the supplying section 7 relative to the intended flow direction fd1 through the manifold 50. According to further embodiments, the coolant outlet 15 may be arranged at the supplying section 7. Furthermore, according to some embodiments, the coolant outlet 15 may be arranged between the receiving section 5 and the supplying section 7 relative to the intended flow direction fd1 through the manifold 50, i.e., at the mixing section 9 referred to above. A great flexibility can be provided for the installation, connection, and routing of coolant conduits due to the different possible placements of the coolant outlet 15 of the coolant distribution manifold 50.

In FIG. 3, the cooling system 1' is illustrated as arranged on the vehicle 2 wherein the vehicle 2 is positioned in an upright use position on a horizontal surface Hs. The horizontal plane hp illustrated in FIG. 3 is thus parallel to the horizontal plane hp illustrated in FIG. 1. Likewise, the local gravity vector gv illustrated in FIG. 3 is parallel to the local gravity vector gv illustrated in FIG. 1.

The local gravity vector gv, as referred to herein, is representative of a local gravity vector gv at the location of the cooling system 1'. The horizontal plane hp is perpendicular to the local gravity vector gv, i.e., the normal to the horizontal plane hp is parallel to the local gravity vector gv. The components of the cooling system 1' are configured to be mounted in an intended mounting position on a vehicle 2. In FIG. 3, the manifold 50 of the cooling system 1', as well as the other components of the cooling system 1', are illustrated in a position corresponding to an intended mounting position thereof.

As can be seen in FIG. 3, the supplying section 7 is arranged above the receiving section 5 when the manifold 50 is mounted in the intended mounting position on a vehicle. Moreover, the manifold 50 comprises a deairing section 19. The deairing section 19 is configured to evacuate air from the manifold 50, as is further explained herein. According to the illustrated embodiments, the cooling system 1' comprises an expansion vessel 73 fluidly connected to the deairing section 19 via a deairing connection e1. In this manner, the expansion vessel 73 is fluidly connected to each of the first and second coolant circuit 6, 8 and each of the further coolant circuits c1-c5.

According to further embodiments, the expansion vessel may be fluidly connected to the first coolant circuit 6 only. The expansion vessel 73 is arranged to handle differences in the volume of coolant in the cooling system 1', i.e., in the first and second coolant circuits 6, 8 respectively. Air entering the deairing section 19 is evacuated from the manifold 50 to the expansion vessel 73 via the deairing connection e1. According to the illustrated embodiments, the deairing section 19 is arranged above the coolant inlet 13, the receiving section 5, and the supplying section 7 when the manifold 50 is mounted in an intended mounting position on a vehicle.

The cooling system 1' comprises a filling point 75 for filling the first coolant circuit 6 with coolant. According to the illustrated embodiments, the filling point 75, as referred to herein, is a filling opening of the expansion vessel 73. The filling opening is covered by an expansion vessel lid, which can be removed when filling the first coolant circuit 6 with coolant. According to further embodiments, the filling point 75, as referred to herein, may be another type of filling point for filling the first coolant circuit 6 with coolant, such as another type of opening or valve assembly. Since the filling point 75 according to the illustrated embodiments is a filling opening of the expansion vessel 73, the filling point 75 can be used to fill coolant into each of the first and second coolant circuit 6, 8 and each of the further coolant circuits c1-c5.

Moreover, as can be seen in FIG. 3, the manifold 50 is arranged such that the intended flow direction fd1 through the manifold 50 has a vertical vector component vc with the same vertical direction along the full length of the flow path through the manifold 50 when the manifold 50 is mounted in the intended mounting position to a vehicle 2 and the vehicle 2 is positioned in an intended use position onto a flat horizontal surface. The feature that the vertical vector component vc has the same vertical direction along the full length of the flow path through the manifold 50 means that the vertical vector component vc does not change its vertical direction from a first vertical direction to a second vertical direction, wherein the second vertical direction is opposite to the first vertical direction. The vertical vector component vc is parallel to the local gravity vector gv.

The manifold 50 may be arranged such that the intended flow direction fd1 through the manifold 50 has a vector component vc being parallel to a local gravity vector gv along the full length of the flow path through the manifold 50 when the manifold 50 is mounted in the intended mounting position to a vehicle 2 and the vehicle 2 is positioned in an intended use position onto a flat horizontal surface. In this manner, air bubbles entering the manifold 50, for example via the receiving section 5, can be transported to the deairing section 19 in an efficient manner by gravity acting on coolant surrounding the air bubbles.

Moreover, as seen in FIG. 3, according to the illustrated embodiments, the deairing section 19 is arranged downstream of the receiving section 5, downstream of the mixing section 9, downstream of the coolant inlet 13, and downstream of the supplying section 7 relative to the intended flow direction fd1 through the manifold 50. In this manner, a further efficient transport of air bubbles is provided towards the deairing section 19 since air bubbles to some extent follow the stream of coolant through the manifold 50.

According to the embodiments illustrated in FIG. 3, each set b1', b2', b3' of propulsion battery cells 4 may form part of the first battery pack 61 illustrated in FIG. 1. According to further embodiments, a set b1', b2', b3' of propulsion battery cells 4, as referred to herein, may comprise battery cells 4 of two or more propulsion battery packs, battery cells 4 of a propulsion battery having a certain voltage, battery cells 4 of a portion of a propulsion battery pack, or the like.

The sets b1', b2', b3' of propulsion battery cells 4 is in some places herein referred to as a number of first components of the vehicle 2. Likewise, the sets b1-b5 of propulsion battery cells 4 is in some places herein referred to as a number of second components of the vehicle 2. According to the embodiments illustrated in FIG. 3, the first coolant circuit 6 of the cooling system 1' is configured to control the temperature of the number of first components, i.e., the sets b1', b2', b3' of propulsion battery cells 4.

According to embodiments herein, the first coolant circuit 6 comprises a primer conduit 18 connected to the conduit section 12 and to the second coolant circuit 8. The primer conduit 18, as referred to herein, may be comprised in the cooling system 1'. As can be seen in FIG. 3, each of the second coolant circuit 8 and the further coolant circuits c1-c5 comprises no conduit portions being arranged below the coolant pump 24, cp1-cp5 of the respective circuit 8, c1-c5 as seen relative to the local gravity vector gv in a flow path from the filling point 75 and the coolant pump 24, cp1-cp5. In this manner, it is ensured that the pump inlet of the respective coolant pump 24, cp1-cp5 is filled with coolant when coolant is filled into the filling point 75.

However, as can be seen in FIG. 3, the first coolant circuit 6 comprises a conduit portion p6 located in a flow path between the filling point 75 and the pump inlet 10' of the first coolant pump 10, wherein the conduit portion p6 is arranged below the pump inlet 10' of the first coolant pump 10 as seen relative to a local gravity vector gv. Since the conduit portion p6 is located between the filling point 75 and the pump inlet 10', and is arranged below the pump inlet 10' of the first coolant pump 10, it cannot be ensured that the pump inlet 10' of the first coolant pump 10 is filled with coolant when coolant is filled into the filling point 75 of the cooling system 1.

This is because air in the first coolant circuit 6 downstream of the conduit portion p6 may create an airlock which prevents a flow of coolant from the filling point 75 to the pump inlet 10' of the first coolant pump 10. That is, due to the conduit portion p6 arranged below the pump inlet 10' of the first coolant pump 10, coolant is hindered from flowing naturally, i.e., by gravity, continuously downwards from the filling point 75 to the pump inlet 10' of the first coolant pump 10. Moreover, air cannot naturally, i.e., by gravity, move up continuously from the pump inlet 10' of the first coolant pump 10 to the filling point 75.

Furthermore, the first coolant circuit 6 comprises no other conduit where coolant naturally, i.e., by gravity, can flow continuously downwards to the pump inlet 10' from the filling point, or a conduit where air naturally, i.e., by gravity, can move up continuously from the pump inlet 10' to the filling point 75. Therefore, a filling of coolant into the filling point 75 with a subsequent operation of the pump inlet 10' of the first coolant pump 10 may not result in a complete filling and deaeration of the first coolant circuit 6.

In FIG. 3, the filling point 75, as well as the expansion vessel 73 comprising the filling point 75, is arranged below the pump inlet 10' of the first coolant pump 10, as seen relative to a local gravity vector gv when the cooling system 1 is arranged on the vehicle 2 and the vehicle 2 is positioned in an upright use position on a horizontal surface Hs. However, an airlock may prevent a flow of coolant from the filling point 75 to the pump inlet 10' of the first coolant pump 10 in the above described manner regardless of whether the filling point 75, and/or the expansion vessel 73, is arranged above or below the pump inlet 10' of the first coolant pump 10 as seen relative to the local gravity vector gv. This is because all portions of the first coolant circuit 6 above the pump inlet 10' of the first coolant pump 10 are closed circuit portions and because the first coolant circuit 6 comprises no other conduit where coolant naturally, i.e., by gravity, can flow continuously downwards to the pump inlet 10' from the filling point, or a conduit where air naturally, i.e., by gravity, can move up continuously from the pump inlet 10' to the filling point 75.

The feature that the conduit portion p6 is located between the filling point 75 and the pump inlet 10' of the first coolant pump 10 means that the conduit portion p6 is located, i.e., is arranged, in a flow path between the filling point 75 and the pump inlet 10' of the first coolant pump 10.

The feature that the conduit portion p6 is arranged below the pump inlet 10' of the first coolant pump 10 as seen relative to a local gravity vector gv means that the conduit portion p6 is arranged below the first coolant pump 10 as seen relative to a local gravity vector gv when the cooling system 1' is arranged on the vehicle 2 and the vehicle 2 is positioned in an upright use position on a horizontal surface Hs. This is because the pump inlet 10' of the first coolant pump 10 is a structural portion of the first coolant pump 10 according to the illustrated embodiments.

Moreover, the feature that the conduit portion p6 is arranged below the first coolant pump 10 as seen relative to a local gravity vector gv when the cooling system 1' is arranged on the vehicle 2 and the vehicle 2 is positioned in an upright use position on a horizontal surface Hs means that the conduit portion p6 is arranged below the first coolant pump 10 as seen relative to the vertical direction vd of the vehicle 2.

As can be seen in FIG. 3, according to the illustrated embodiments, the pump inlet 10' of the first coolant pump 10 is arranged at a higher position than a coolant level L1 of the second coolant circuit 8 as seen relative to the local gravity vector gv when the cooling system 1' is arranged on the vehicle 2 and the vehicle 2 is positioned in an upright use position on a horizontal surface Hs. The coolant level L1 of the second coolant circuit 8 as referred to herein may be an intended coolant level L1 of the second coolant circuit 8, i.e., a coolant level L1 to which the second coolant circuit 8 is intended to be filled with coolant before operating the second coolant circuit 8. According to the illustrated embodiments, the coolant level L1 of the second coolant circuit 8 coincides with the position of the deairing connection e1 of the coolant distribution manifold 50. However, the coolant level L1 of the second coolant circuit 8 may be at a conduit connection the expansion vessel 73 and the deairing connection e1 of the coolant distribution manifold 50.

The feature that the pump inlet 10' of the first coolant pump 10 is arranged at a higher position than a coolant level L1 of the second coolant circuit 8 means that the first coolant pump 10 is arranged at a higher position than a coolant level L1 of the second coolant circuit 8 when the cooling system 1' is arranged on the vehicle 2 and the vehicle 2 is positioned in an upright use position on a horizontal surface Hs. This is because the pump inlet 10' of the first coolant pump 10 is a structural portion of the first coolant pump 10 according to the illustrated embodiments.

Moreover, the feature that the pump inlet 10' of the first coolant pump 10 is arranged at a higher position than the coolant level L1 of the second coolant circuit 8 when the cooling system 1' is arranged on the vehicle 2 and the vehicle 2 is positioned in an upright use position on a horizontal surface Hs means that the pump inlet 10' of the first coolant pump 10 is arranged at a higher position than the coolant level L1 of the second coolant circuit 8 as seen relative to the vertical direction vd of the vehicle 2.

The cooling system 1' further comprises a control arrangement 21. The control arrangement 21 is configured to initiate a supply of coolant from the second coolant circuit 8 to the conduit section 12 via the primer conduit 18 during standstill of the first coolant pump 10, and then initiate operation of the first coolant pump 10. In this manner, the need for performing a manual deaeration of the first coolant circuit 6 is circumvented or is at least reduced. Moreover, the control performed by the control arrangement 21 of the cooling system 1' provides conditions for more freedom in the vertical placement of the first coolant pump 10 relative to other parts of the cooling system 1' while ensuring that the pump inlet 10' of the first coolant pump 10 is supplied with coolant before initiating operation of the first coolant pump 10. As an example, due to the control performed by the control arrangement 21 of the cooling system 1', the first coolant pump 10 is allowed to be arranged above the coolant level L1 of the second coolant circuit 8 without risking an insufficient supply of coolant to the pump inlet 10' of the first coolant pump 10 during start-up of the first coolant pump 10.

According to the illustrated embodiments, the primer conduit 18 is connected to a pressure portion 20 of the second coolant circuit 8. The wording pressure portion 20 means that the fluid pressure of the pressure portion 20 is higher than an average fluid pressure in the second coolant circuit 8. According to the illustrated embodiments, the primer conduit 18 of the cooling system 1' is connected to a pressure portion 20 of the second coolant circuit 8 located downstream of the second coolant pump 24. In more detail, according to the illustrated embodiments, the pressure portion 20 is located downstream of the second coolant pump 24 and upstream of the heat exchanger 23 and the coolant distribution manifold 50 as seen relative the direction of coolant flow in the second coolant circuit 8 during operation of the second coolant pump 24.

Moreover, according to the illustrated embodiments, the cooling system 1' comprises a valve 22. The valve 22 is controllable between an open state, in which the valve 22 allows flow of coolant through the primer conduit 18, and a closed state, in which the valve 22 blocks flow of coolant through the primer conduit 18. According to the illustrated embodiments, the control arrangement 21 is configured to initiate the supply of coolant from the second coolant circuit 8 to the conduit section 12 via the primer conduit 18 by controlling the valve 22 to the open state.

Moreover, according to the illustrated embodiments, the control arrangement 21 is configured to initiate the supply of coolant from the second coolant circuit 8 to the conduit section 12 by operating the second coolant pump 24. However, according to further embodiments, the second coolant pump 24 may be operated by another device, arrangement, or system than the control arrangement 21 depicted in FIG. 3.

Accordingly, due to these features, when the second coolant pump 24 is operating and the valve 22 is in the open state, the conduit section 12 can be filled with coolant from the second coolant circuit 8 via the primer conduit 18 by the pumping action of the second coolant pump 24 of the second coolant circuit 8.

In FIG. 3, a second and a third level L2, L3 are indicated. The second level L2 indicates a vertical height of the pump inlet 10' of the first coolant pump 10, i.e., a vertical height of the pump inlet 10' relative to the local gravity vector gv when the vehicle 2 is positioned in an upright use position on a horizontal surface Hs. As seen in FIG. 3, the second level L2 is higher than the coolant level L1 of the second coolant circuit 8 as seen relative to the vertical direction vd of the vehicle 2.

According to the illustrated embodiments, the conduit section 12 comprises at least one portion 12*b* arranged at a higher position than the pump inlet 10' of the first coolant pump 10 as seen relative to the local gravity vector gv when the cooling system 1' is arranged on the vehicle 2 and the vehicle 2 is positioned in an upright use position on a horizontal surface Hs. The third level L3 in FIG. 3 indicates the vertical height of a top portion of the at least one portion 12*b* of the conduit section 12. Since the at least one portion 12*b* is arranged at a higher position than the pump inlet 10' of the first coolant pump 10 as seen relative to the vertical direction vd of the vehicle 2, the at least one portion 12*b* can act as an air trap for trapping air, if present in the conduit section 12*b*, also after the conduit section 12 has been filled with coolant via the primer conduit 18.

The conduit section 12 further comprises a main portion 12*a* arranged between the at least one portion 12*b* and the pump inlet 10' of the first coolant pump 10. The main portion 12*a* of the conduit section 12 is arranged at and below the second level L2 referred to above. According to the illustrated embodiments, the primer conduit 18 is connected to the main portion 12*a* of the conduit section 12. However, according to further embodiments, the primer conduit 18 may be connected to another portion of the conduit section 12.

Moreover, according to the illustrated embodiments, the first coolant pump 10 is a centrifugal pump, i.e., a coolant pump allowing coolant flow through the pump also at standstill thereof.

During a filling procedure of coolant from the second coolant circuit 8 to the conduit section 12 via the primer conduit 18, air can pass through the first coolant pump 10 and the conduit section 12 of the first coolant circuit 6 can be filled with coolant to the level L3 indicated in FIG. 3. Thus, during such a filling procedure of coolant from the second coolant circuit 8 to the conduit section 12 via the primer conduit 18, coolant can be pumped, using the second coolant pump 24, to the conduit section 12 and through the first coolant pump 10 into a portion of an outlet duct of the first coolant pump 10 to the level L3 indicated in FIG. 3.

In this state, the at least one section 12*b* of the conduit section 12, the main section 12*a* of the conduit section 12, and the portion of the outlet duct of the first coolant pump 10 is filled with coolant to the level L3 indicated in FIG. 3. In this manner, operation of the first coolant pump 10 can be initiated without risking an insufficient supply of coolant to the pump inlet 10' of the first coolant pump 10. Moreover, any remaining air, if present, can be trapped in the at least one section 12*b* of the conduit section 12 during the filling procedure as well as when operation of the first coolant pump 10 has been initiated.

Any air pumped into the coolant distribution manifold 50 from the first coolant circuit 6 via the receiving connection r6 at the receiving section 5 of the coolant distribution manifold 50 can be removed in an efficient manner by the coolant distribution manifold 50, i.e., can be evacuated in an efficient manner to the expansion vessel 73 via the deairing connection e1 of the coolant distribution manifold 50.

Figure 4:
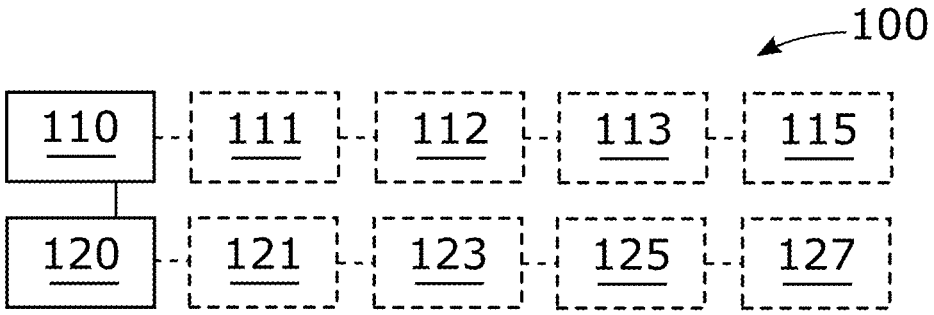

FIG. 4 schematically illustrates a method 100 of operating a cooling system of a vehicle. The vehicle may be a vehicle 2 according to the embodiments illustrated in FIG. 1. Moreover, the cooling system may be a cooling system 1 according to the embodiments illustrated in FIG. 2 or a cooling system 1' according to the embodiments illustrated in FIG. 3. Therefore, below, simultaneous reference is made to FIG. 1-FIG. 4, if not indicated otherwise.

The method 100 is a method 100 of operating a cooling system 1, 1' of a vehicle 2, wherein the cooling system 1, 1' comprises a first and a second coolant circuit 6, 8 each configured to control the temperature of a number of components b1'-b3', b1-b5 of the vehicle 2, wherein the cooling system 1, 1' comprises a filling point 75 for filling the first coolant circuit 6 with coolant, and wherein the first coolant circuit 6 comprises:

- a first coolant pump 10 configured to pump coolant through the first coolant circuit 6,
- a conduit section 12 connected to a pump inlet 10' of the first coolant pump 10,
- a primer conduit 18 connected to the conduit section 12 and to the second coolant circuit 8, and
- a conduit portion p6 located between the filling point 75 and the pump inlet 10' of the first coolant pump 10, wherein the conduit portion p6 is arranged below the pump inlet 10' of the first coolant pump 10 as seen relative to a local gravity vector gv, and wherein the method 100 comprises the steps of:

- initiating 110 a supply of coolant from the second coolant circuit 8 to the conduit section 12 via the primer conduit 18 during standstill of the first coolant pump 10, and then
- initiating 120 operation of the first coolant pump 10.

As a result, a method 100 is provided circumventing, or at least reducing the need for performing, a manual deaeration of the first coolant circuit 6. This is because the supply of coolant from the second coolant circuit 8 to the conduit section 12 via the primer conduit 18 can ensure that the pump inlet 10' of the first coolant pump 10 is supplied with coolant before operation of the first coolant pump 10 is initiated despite the fact that the conduit portion p6 is arranged below the pump inlet 10' of the first coolant pump 10 as seen relative to the local gravity vector gv.

Moreover, the method 100 provides conditions for more freedom in the vertical placement of the first coolant pump 10 relative to other parts of the cooling system 1, 1' while ensuring that the pump inlet 10' of the first coolant pump 10 is supplied with coolant before initiating operation of the first coolant pump 10. For example, the method provides conditions for a cooling system 1, 1' in which the first coolant pump 10 is arranged at a higher position than a coolant level L1 of the second coolant circuit 8 as seen relative to a local gravity vector gv when the vehicle 2 is positioned in an upright use position on a horizontal surface Hs, while ensuring that the pump inlet 10' of the first coolant pump 10 is supplied with coolant before initiating operation of the first coolant pump 10. In this manner, a method 100 is provided which can reduce packing problems and facilitate the routing and placement of conduits and other parts of cooling systems 1, 1' of vehicles 2.

In addition, since the need for performing a manual deaeration of the first coolant circuit 6 is circumvented, or at least reduced, a method 100 is provided having conditions for reducing assembly costs, service, repair, and maintenance costs, as well as operational costs of vehicles 2. This is because the method provides conditions for filling the first coolant circuit 6 with coolant from the second coolant circuit 8 instead of preforming a manual deaeration of the first coolant circuit 6.

Moreover, a method 100 is provided capable of reducing the risk of damage of the first coolant pump 10 and the number of components of the vehicle 2 being temperature controlled by the first coolant circuit 6. As a further result, a method is provided capable of reducing the risk of vehicle standstills due to an insufficient supply of coolant to the first coolant pump 10 of the first coolant circuit 6.

Figure 5A:
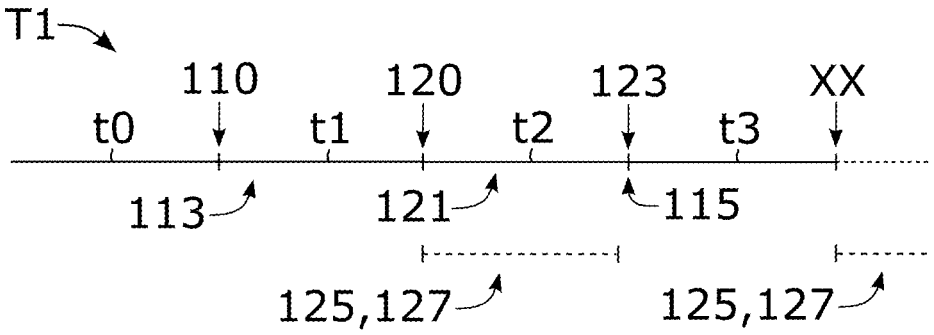

FIG. 5*a* schematically illustrates a first timeline T1 indicating some of the steps of the method 100 according to some embodiments. Below, simultaneous reference is made to FIG. 1-FIG. 5*a*, if not indicated otherwise.

As can be seen in FIG. 5*a*, and as is indicated above, the step of initiating 110 the supply of coolant from the second coolant circuit 8 to the conduit section 12 via the primer conduit 18 during standstill of the first coolant pump 10 is performed prior to the step of initiating 120 operation of the first coolant pump 10.

Moreover, as is indicated in FIG. 4 and FIG. 5*a*, the method 100 may further comprise the step of:

supplying 113 coolant from the second coolant circuit 8 to the conduit section 12 via the primer conduit 18 during a first time period t1 before the step of initiating 120 operation of the first coolant pump 10.

The first time period t1 may last a number of seconds, such as 2-40 seconds, or 2-20 seconds. In this manner, it can be ensured that the conduit section 12 is filled with coolant before operation of the first coolant pump 10 is initiated.

Furthermore, as is indicated in FIG. 4 and FIG. 5*a*, the method 100 may further comprise the steps of:

maintaining 121 operation of the first coolant pump 10 during a second time period t2, stopping 123 operation of the first coolant pump 10 at the end of the second time period t2, and then initiating 115 a second supply of coolant from the second coolant circuit 8 to the conduit section 12 via the primer conduit 18.

In this manner, it can be ensured that the conduit section 12 is not emptied of coolant by the operation of the first coolant pump 10. As a further result, a method 100 is provided further reducing the need for performing a manual deaeration of the first coolant circuit 6.

As indicated in FIG. 5*a*, the second time period t2 may start when initiating 120 operation of the first coolant pump 10. Moreover, the second time period t2 and ends when stopping 123 operation of the first coolant pump 10. The duration of the second time period may be a number of seconds, such as 2-40 seconds, or 2-20 seconds.

As indicated by the reference sign "XX" in FIG. 5*a*, this pattern may be repeated. In other words, the method 100 may comprise steps such as:

maintaining operation of the first coolant pump 10 during a third time period, stopping operation of the first coolant pump 10 at the end of the third time period, and then initiating a third supply of coolant from the second coolant circuit 8 to the conduit section 12 via the primer conduit 18.

According to Embodiments Herein, the Method 100 May Comprise the Step of:

maintaining 125 the supply of coolant from the second coolant circuit 8 to the conduit section 12 via the primer conduit 18 during operation of the first coolant pump 10.

In other words, the method 100 may comprise the step of operating first coolant pump 10 when supplying coolant from the second coolant circuit 8 to the conduit section 12 via the primer conduit 18.

Moreover, the Method 100 May Comprise the Step of:

operating 127 the first coolant pump 10 with a reduced pumping rate when supplying coolant from the second coolant circuit 8 to the conduit section 12 via the primer conduit 18.

The reduced pumping rate, as referred to herein, may be a pumping rate being lower than a pumping rate during normal operation of the first coolant circuit 6 and the first coolant pump 10. The reduced pumping rate may be set such that flow rate of coolant pumped by the first coolant pump 10 is lower than, or equal to, the flow rate of coolant supplied from the second coolant circuit 8 to the conduit section 12 via the primer conduit 18. In this manner, it can be ensured that the conduit section 12 is not emptied of coolant by the operation of the first coolant pump 10.

Figure 5B:
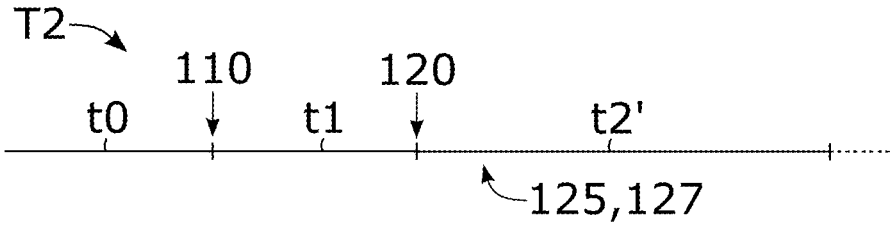

FIG. 5*b* schematically illustrates a second timeline T2 indicating some of the steps of the method 100 according to embodiments herein. Below, simultaneous reference is made to FIG. 1-FIG. 4, and FIG. 5*b*, if not indicated otherwise.

According to the Embodiments Illustrated in FIG. 5*b*, the Method 100 Comprises the Steps of:

initiating 110 a supply of coolant from the second coolant circuit 8 to the conduit section 12 via the primer conduit 18 during standstill of the first coolant pump 10, and then initiating 120 operation of the first coolant pump 10.

Moreover, the Method 100 Comprises the Step of:

maintaining 125 the supply of coolant from the second coolant circuit 8 to the conduit section 12 via the primer conduit 18 during operation of the first coolant pump 10.

In other words, the method 100 comprises the step of operating first coolant pump 10 when supplying coolant from the second coolant circuit 8 to the conduit section 12 via the primer conduit 18.

Moreover, the Method 100 May Comprise the Step of:

operating 127 the first coolant pump 10 with a reduced pumping rate when supplying coolant from the second coolant circuit 8 to the conduit section 12 via the primer conduit 18.

As above, the reduced pumping rate may be set such that flow rate of coolant pumped by the first coolant pump 10 is lower than, or equal to, the flow rate of coolant supplied from the second coolant circuit 8 to the conduit section 12 via the primer conduit 18. In this manner, it can be ensured that the conduit section 12 is not emptied of coolant by the operation of the first coolant pump 10 without having to stop the operation of the first coolant pump 10.

Instead, as indicated in FIG. 5*b*, the step of maintaining 125 the supply of coolant, and/or the step of operating 127 the first coolant pump 10 with a reduced pumping rate, may be performed during a second time period t2', which second time period t2' may be longer than the second time period t2 indicated in FIG. 5*a*.

Below, simultaneous reference is made to FIG. 1-FIG. 5*b*, if not indicated otherwise. According to some embodiments, the primer conduit 18 is connected to a pressure portion 20 of the second coolant circuit 8, wherein the first coolant circuit 6 comprises a valve 22 controllable between an open state, in which the valve 22 allows flow of coolant through the primer conduit 18, and a closed state, in which the valve 22 blocks flow of coolant through the primer conduit 18, and wherein the step of initiating 110 a supply of coolant from the second coolant circuit 8 to the conduit section 12 via the primer conduit 18 comprises the step of:

controlling 111 the valve 22 to the open state.

Moreover, according to some embodiments, the second coolant circuit 8 comprises a second coolant pump 24, and wherein the primer conduit 18 is connected to a portion 20 of the second coolant circuit 8 located downstream of the second coolant pump 24, and wherein the step of initiating 110 a supply of coolant from the second coolant circuit 8 to the conduit section 12 comprises the step of:

operating 112 the second coolant pump 24.

The method 100 according to the present disclosure may be initiated after assembly of the first coolant circuit 6 and/or the second coolant circuit 8. Moreover, method 100 according to the present disclosure may be initiated after a service, maintenance, or repair procedure of a vehicle 2 comprising the cooling system 1, 1'.

Moreover, according to some embodiments, the method 100 may comprise the step of detecting a deaeration need of the first coolant circuit 6. The step of detecting the deaeration need of the first coolant circuit 6 may comprise the step of estimating a coolant level of the first coolant circuit 6. Any of such steps may be perform during the time period to indicated in FIG. 5*a* and FIG. 5*b*, i.e., during a time period prior to the first time period t1. Moreover, the method 100 may comprise the steps of initiating 110 the supply of coolant from the second coolant circuit 8 to the conduit section 12 via the primer conduit 18 during standstill of the first coolant pump 10, and then initiating 120 operation of the first coolant pump 10, if the estimated coolant level of the first coolant circuit 6 is below a threshold level.

The coolant level of the first coolant circuit 6 may for example be estimated using a coolant level sensor. Moreover, according to some embodiments, the first coolant pump 10 comprises an electric motor, wherein the step of estimating the coolant level in the first coolant circuit 6 comprises the step of monitoring electrical quantities of the electric motor of the first coolant pump 10.

The coolant level in the first coolant circuit 6 can be estimated by monitoring the electrical quantities of the electric motor of the first coolant pump 10 because an insufficient supply of coolant to the pump inlet 10' of the first coolant pump 10 causes the pumping resistance to decrease and the rotational velocity of the first coolant pump 10 to increase.

In the embodiments of the method explained with reference to FIG. 5*a*, the step of stopping 123 operation of the first coolant pump 10 may be performed upon a detection of an insufficient supply of coolant to the pump inlet 10' of the first coolant pump 10. In this manner, damage to the first coolant pump 10 can be further avoided. In the embodiments of the method explained with reference to FIGS. 5*a* and 5*b*, the pumping rate of the first coolant pump 10 may be further reduced upon a detection of an insufficient supply of coolant to the pump inlet 10' of the first coolant pump 10. In this manner, damage to the first coolant pump 10 can be further avoided.

As understood from the herein described, the method 100 can be used for filling and deaerating the first coolant circuit 6 of the cooling system 1, 1'. Therefore, the method 100 according to embodiments herein may also be referred to as a method 100 of filling and/or deaerating a first coolant circuit 6 of a cooling system 1, 1' of a vehicle 2.

It will be appreciated that the various embodiments described for the method 100 are all combinable with the control arrangement 21 as described herein. That is, the control arrangement 21 may be configured to perform any one of the method steps 110, 120, 111, 112, 113, 115, 121, 123, 125, and 127 of the method 100.

Figure 6:
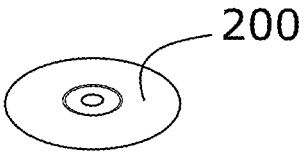
FIG. 6 illustrates a computer-readable medium.

FIG. 6 illustrates a computer-readable medium 200 comprising instructions which, when executed by a computer, cause the computer to carry out the method 100 according to some embodiments.

According to some embodiments, the computer-readable medium 200 comprises a computer program comprising instructions which, when the program is executed by a computer, cause the computer to carry out the method 100 according to some embodiments.

The control arrangement 21, as referred to herein, may be comprised in the vehicle 2 and may be connected to one or more components of the vehicle 2, such as one or more components of the cooling system 1, 1', in order to perform the method 100 illustrated in FIG. 4. One skilled in the art will appreciate that the method 100 of operating a cooling system 1, 1' of a vehicle 2 may be implemented by programmed instructions. These programmed instructions are typically constituted by a computer program, which, when it is executed in the control arrangement 21, ensures that the control arrangement 21 carries out the desired control, such as the method steps 110, 120, 111, 112, 113, 115, 121, 123, 125, and 127 described herein. The computer program is usually part of a computer program product 200 which comprises a suitable digital storage medium on which the computer program is stored.

The control arrangement 21 may comprise a calculation unit which may take the form of substantially any suitable type of processor circuit or microcomputer, e.g., a circuit for digital signal processing (digital signal processor, DSP), a Central Processing Unit (CPU), a processing unit, a processing circuit, a processor, an Application Specific Integrated Circuit (ASIC), a microprocessor, or other processing logic that may interpret and execute instructions. The herein utilised expression "calculation unit" may represent a processing circuitry comprising a plurality of processing circuits, such as, e.g., any, some or all of the ones mentioned above.

The control arrangement 21 may further comprise a memory unit, wherein the calculation unit may be connected to the memory unit, which may provide the calculation unit with, for example, stored program code and/or stored data which the calculation unit may need to enable it to do calculations. The calculation unit may also be adapted to store partial or final results of calculations in the memory unit. The memory unit may comprise a physical device utilised to store data or programs, i.e., sequences of instructions, on a temporary or permanent basis. According to some embodiments, the memory unit may comprise integrated circuits comprising silicon-based transistors. The memory unit may comprise e.g., a memory card, a flash memory, a USB memory, a hard disc, or another similar volatile or non-volatile storage unit for storing data such as e.g., ROM (Read-Only Memory), PROM (Programmable Read-Only Memory), EPROM (Erasable PROM), EEPROM (Electrically Erasable PROM), etc. in different embodiments.

The control arrangement 21 is connected to components of the cooling system 1, 1' and/or the vehicle 2 for receiving and/or sending input and output signals. These input and output signals may comprise waveforms, pulses, or other attributes which the input signal receiving devices can detect as information and which can be converted to signals processable by the control arrangement 21. These signals may then be supplied to the calculation unit. One or more output signal sending devices may be arranged to convert calculation results from the calculation unit to output signals for conveying to other parts of the vehicle's control system and/or the component or components for which the signals are intended. Each of the connections to the respective components of the cooling system 1, 1' and/or the vehicle 2 for receiving and sending input and output signals may take the form of one or more from among a cable, a data bus, e.g., a CAN (controller area network) bus, a MOST (media orientated systems transport) bus or some other bus configuration, or a wireless connection.

In the embodiments illustrated, the vehicle 2 comprises a control arrangement 21 but might alternatively be implemented wholly or partly in two or more control arrangements or two or more control units.

Control systems in modern vehicles generally comprise a communication bus system consisting of one or more communication buses for connecting a number of electronic control units (ECUs), or controllers, to various components on board the vehicle. Such a control system may comprise a large number of control units and taking care of a specific function may be shared between two or more of them. Vehicles of the type here concerned are therefore often provided with significantly more control arrangements than depicted in FIG. 2 and FIG. 3, as one skilled in the art will surely appreciate.

The computer program product 200 may be provided for instance in the form of a data carrier carrying computer program code for performing at least some of the method steps 110, 120, 111, 112, 113, 115, 121, 123, 125, and 127 according to some embodiments when being loaded into one or more calculation units of the control arrangement 21. The data carrier may be, e.g. a CD ROM disc, as is illustrated in FIG. 6, or a ROM (read-only memory), a PROM (programable read-only memory), an EPROM (erasable PROM), a flash memory, an EEPROM (electrically erasable PROM), a hard disc, a memory stick, an optical storage device, a magnetic storage device or any other appropriate medium such as a disk or tape that may hold machine readable data in a non-transitory manner. The computer program product may furthermore be provided as computer program code on a server and may be downloaded to the control arrangement 21 remotely, e.g., over an Internet or an intranet connection, or via other wired or wireless communication systems.

It is to be understood that the foregoing is illustrative of various example embodiments and that the invention is defined only by the appended independent claims. A person skilled in the art will realize that the example embodiments may be modified, and that different features of the example embodiments may be combined to create embodiments other than those described herein, without departing from the scope of the present invention, as defined by the appended independent claims.

As used herein, the term "comprising" or "comprises" is open-ended, and includes one or more stated features, elements, steps, components, or functions but does not preclude the presence or addition of one or more other features, elements, steps, components, functions, or groups thereof.

The invention claimed is:

1. A method of operating a cooling system of a vehicle, the cooling system comprising a first and a second coolant circuit each configured to control the temperature of a number of components of the vehicle, wherein the cooling system comprises a filling point for filling the first coolant circuit with coolant, and wherein the first coolant circuit comprises:

a first coolant pump configured to pump coolant through the first coolant circuit, a conduit section connected to a pump inlet of the first coolant pump, a primer conduit connected to the conduit section and to the second coolant circuit, and a conduit portion located between the filling point and the pump inlet of the first coolant pump, wherein the conduit portion is arranged below the pump inlet of the first coolant pump as seen relative to a local gravity vector, and wherein the method comprises the steps of:

initiating a supply of coolant from the second coolant circuit to the conduit section via the primer conduit during standstill of the first coolant pump, and then initiating operation of the first coolant pump.

2. The method according to claim 1, wherein the method further comprises the step of:

supplying coolant from the second coolant circuit to the conduit section via the primer conduit during a first time period before the step of initiating operation of the first coolant pump.

3. The method according to claim 1, wherein the method further comprises the steps of:

maintaining operation of the first coolant pump during a second time period, stopping operation of the first coolant pump at the end of the second time period, and then initiating a second supply of coolant from the second coolant circuit to the conduit section via the primer conduit.

4. The method according to claim 1, wherein the method comprises the step of:

maintaining the supply of coolant from the second coolant circuit to the conduit section via the primer conduit during operation of the first coolant pump.

5. The method according to claim 4, wherein the method comprises the step of:

operating the first coolant pump with a reduced pumping rate when supplying coolant from the second coolant circuit to the conduit section via the primer conduit.

6. The method according to claim 1, wherein the primer conduit is connected to a pressure portion of the second coolant circuit, and wherein the first coolant circuit comprises a valve controllable between an open state, in which the valve allows flow of coolant through the primer conduit, and a closed state, in which the valve blocks flow of coolant through the primer conduit, and wherein the step of initiating a supply of coolant from the second coolant circuit to the conduit section via the primer conduit comprises the step of:

controlling the valve to the open state.

7. The method according to claim 1, wherein the second coolant circuit comprises a second coolant pump, and wherein the primer conduit is connected to a portion of the second coolant circuit located downstream of the second coolant pump, and wherein the step of initiating a supply of coolant from the second coolant circuit to the conduit section comprises the step of:

operating the second coolant pump.

8. A non-transitory computer-readable medium comprising instructions which, when executed by a computer, cause the computer to carry out the method according to claim 1.

9. A control arrangement for controlling operation of a cooling system of a vehicle, the cooling system comprising a first and a second coolant circuit each configured to control the temperature of a number of components of the vehicle, wherein the cooling system comprises a filling point for filling the first coolant circuit with coolant, and wherein the first coolant circuit comprises:

a first coolant pump configured to pump coolant through the first coolant circuit, a conduit section connected to a pump inlet of the first coolant pump, a primer conduit connected to the conduit section and to the second coolant circuit, and a conduit portion located between the filling point and the pump inlet of the first coolant pump, wherein the conduit portion is arranged below the pump inlet of the first coolant pump as seen relative to a local gravity vector, and wherein the control arrangement is configured to:

initiate a supply of coolant from the second coolant circuit to the conduit section via the primer conduit during standstill of the first coolant pump, and then initiate operation of the first coolant pump.

10. A cooling system for a vehicle, wherein the cooling system comprises a first and a second coolant circuit each configured to control the temperature of a number of components of the vehicle, and wherein the cooling system comprises a filling point for filling the first coolant circuit with coolant, and wherein the first coolant circuit comprises:

a first coolant pump configured to pump coolant through the first coolant circuit, a conduit section connected to a pump inlet of the first coolant pump, a primer conduit connected to the conduit section and to the second coolant circuit, and a conduit portion located between the filling point and the pump inlet of the first coolant pump, wherein the conduit portion is arranged below the pump inlet of the first coolant pump as seen relative to a local gravity vector when the cooling system is arranged on the vehicle and the vehicle is positioned in an upright use position on a horizontal surface, and wherein the cooling system comprises a control arrangement according to claim 9.

11. The cooling system according to claim 10, wherein the conduit section comprises at least one portion arranged at a higher position than the pump inlet of the first coolant pump as seen relative to the local gravity vector when the cooling system is arranged on the vehicle and the vehicle is positioned in an upright use position on a horizontal surface.

12. The cooling system according to claim 10, wherein the first coolant circuit is configured to control the temperature of a number of sets of propulsion battery cells.

13. The cooling system according to claim 10, wherein the second coolant circuit comprises a coolant distribution manifold, and wherein the cooling system comprises at least two further coolant circuits each configured to exchange coolant in the coolant distribution manifold, and wherein the second coolant circuit is a temperature conditioning circuit configured to regulate the temperature of the coolant in the coolant distribution manifold.

14. The cooling system according to claim 13, wherein the first coolant circuit exchanges coolant in the coolant distribution manifold.

15. The cooling system according to claim 13, wherein each of the at least two further coolant circuits is configured to control the temperature of a respective set of propulsion battery cells.

16. A vehicle comprising a number of first components, a number of second components, and a cooling system according to claim 11, wherein the first coolant circuit is configured to control the temperature of the number of first components and the second coolant circuit is configured to control the temperature of the number of second components, and wherein the conduit portion of the first coolant circuit is arranged below the pump inlet of the first coolant pump as seen relative to a local gravity vector when the cooling system is arranged on the vehicle and the vehicle is positioned in an upright use position on a horizontal surface.

17. The vehicle according to claim 16, wherein the number of first components is/are arranged at a higher position than the number of second components as seen relative to a local gravity vector when the vehicle is positioned in an upright use position on a horizontal surface.

* * * * *